US008123580B1

(12) United States Patent
Meyerhoffer

(10) Patent No.: US 8,123,580 B1
(45) Date of Patent: Feb. 28, 2012

(54) INTERFACE SYSTEM FOR SEGMENTED SURFBOARD

(75) Inventor: Thomas Erik Meyerhoffer, Montara, CA (US)

(73) Assignee: Thomas Erik Meyerhoffer, Montara, CA (US)

( * ) Notice: Subject to any disclaimer, the term of this patent is extended or adjusted under 35 U.S.C. 154(b) by 217 days.

(21) Appl. No.: 12/731,096

(22) Filed: Mar. 24, 2010

Related U.S. Application Data

(60) Provisional application No. 61/225,856, filed on Jul. 15, 2009.

(51) Int. Cl.
*A63C 5/03* (2006.01)
*B63B 35/81* (2006.01)

(52) U.S. Cl. ..... 441/74

(58) Field of Classification Search ..... 441/65, 441/68, 74, 79; 114/39.12, 39.14, 39.15
See application file for complete search history.

(56) References Cited

U.S. PATENT DOCUMENTS

| | | | |
|---|---|---|---|
| 3,137,873 | A | 6/1964 | Garrolini |
| 3,287,754 | A | 11/1966 | Price et al. |
| 3,409,920 | A | 11/1968 | Brownley |
| 3,879,782 | A | 4/1975 | Oliver |
| 3,988,794 | A | 11/1976 | Tinkler et al. |
| 3,996,868 | A | 12/1976 | Schagen |
| D260,106 | S | 8/1981 | Peritz |
| 4,496,325 | A | 1/1985 | Tweg |
| 4,598,659 | A | 7/1986 | Chinnery |
| 4,619,619 | A | 10/1986 | Muse, Jr. |
| 4,649,847 | A | 3/1987 | Tinkler et al. |
| 4,730,574 | A | 3/1988 | Diefendahl et al. |
| 4,807,549 | A | 2/1989 | Rhodes et al. |
| 4,829,926 | A | 5/1989 | Voelkel |
| 4,919,632 | A | 4/1990 | Smith et al. |
| 4,929,207 | A | 5/1990 | Piatt |
| 4,963,111 | A | 10/1990 | Moulin |
| 4,995,843 | A | 2/1991 | Englemann |
| 5,174,220 | A | 12/1992 | Skedeleski et al. |
| 5,195,444 | A | 3/1993 | Daniels |
| 5,328,397 | A | 7/1994 | Whitty |
| 5,425,321 | A | 6/1995 | Tinkler |
| 5,464,359 | A | 11/1995 | Whitty |
| 5,476,403 | A | 12/1995 | Hsia |
| 5,514,018 | A | 5/1996 | Hara |
| D377,072 | S | 12/1996 | Ilejay |
| 5,672,081 | A | 9/1997 | Whitty |

(Continued)

FOREIGN PATENT DOCUMENTS

| | | | |
|---|---|---|---|
| DE | 3218236 | A1 | 11/1983 |

(Continued)

*Primary Examiner* — Daniel Venne
(74) *Attorney, Agent, or Firm* — Mahamedi Paradice Kreisman LLP; William L. Paradice, III

(57) ABSTRACT

A waterboard includes a head segment having a concave rear edge, a tail segment having a convex front edge, an interface system adapted to removably connect the head and tail segments together. The interface system includes a head interface connecter having a convex first surface attached to the concave rear edge of the head segment and having a first blade element extending from a second surface thereof, and includes a tail interface connecter having a concave first surface mating attached to the convex front edge of the tail segment and having a second surface mating with and removably attached to the second surface of the first interface connecter, wherein the tail interface connecter includes a slot to receive the blade element.

20 Claims, 24 Drawing Sheets

U.S. PATENT DOCUMENTS

| | | | | |
|---|---|---|---|---|
| 5,683,280 | A | 11/1997 | Winner | |
| 5,711,692 | A | 1/1998 | Pope | |
| 5,810,630 | A | 9/1998 | Saghri | |
| 5,816,179 | A | 10/1998 | Winner | |
| 5,975,974 | A | 11/1999 | McCausland | |
| 6,012,734 | A | 1/2000 | Skedeleski | |
| 6,059,621 | A | 5/2000 | Vogel | |
| 6,168,486 | B1 | 1/2001 | Lin | |
| 6,241,568 | B1 | 6/2001 | Simms | |
| 6,386,933 | B1 | 5/2002 | Rewald et al. | |
| 6,561,118 | B2 | 5/2003 | Mead | |
| 6,623,323 | B1 | 9/2003 | Mead | |
| 6,656,005 | B2 | 12/2003 | Meyerhoffer | |
| 7,029,350 | B2 | 4/2006 | Katzfey | |
| 7,121,909 | B1 | 10/2006 | Meyerhoffer | |
| 7,347,755 | B1 | 3/2008 | Katzfey | |
| 7,390,234 | B2 * | 6/2008 | Peach | 441/74 |
| 7,635,137 | B2 * | 12/2009 | Gregory et al. | 280/87.05 |
| 7,794,297 | B1 * | 9/2010 | Katzfey | 441/74 |
| 7,976,034 | B1 * | 7/2011 | Hong et al. | 280/87.042 |

FOREIGN PATENT DOCUMENTS

| | | | |
|---|---|---|---|
| EP | 0 052 783 | A1 | 6/1982 |
| EP | 0 061 878 | A2 | 10/1982 |
| FR | 2572703 | A1 | 5/1986 |
| GB | 2 336 132 | A | 10/1999 |

* cited by examiner

INTERFACE SYSTEM FOR SEGMENTED SURFBOARD

CROSS-REFERENCE TO RELATED APPLICATIONS

This application claims the benefit under 35 USC 119(e) of the co-pending and commonly owned U.S. Provisional Application No. 61/225,856 entitled "Segmented Surfboard and Attachment Mechanisms" filed on Jul. 15, 2009, which is incorporated by reference herein.

TECHNICAL FIELD

The disclosure herein relates generally to waterboards, and more specifically to a segmented surfboard having interchangeable parts.

BACKGROUND

Surfboards come in a variety of shapes and sizes, each having one or more unique performance characteristics. For example, a longboard may be preferable for casual surfing, while a shortboard may be more suitable for competition-style surfing. Although it may be desirable to bring multiple surfboards to a beach (e.g., depending on a surfer's mood and/or surf conditions), such practice has not always been practical.

A typical surfboard is taller than the average human, and generally ranges from about 6 to 10 feet in length. Due to their size and weight, surfboards are difficult to transport from one location to another. For example, many airlines now charge hefty premiums for checking a surfboard on board a plane. Furthermore, the high cost of surfboards may prevent people from purchasing a large number of surfboards in the first place.

Accordingly, it may be desirable to have the option of choosing from several different surfboard characteristics without actually having to carry around an equivalent number of surfboards. In addition, it may be desirable to increase the portability of a surfboard (or of multiple surfboards) without having to sacrifice the performance of the board.

BRIEF DESCRIPTION OF THE DRAWINGS

The disclosure herein is illustrated by way of example, and not by way of limitation, in the figures of the accompanying drawings and in which like reference numerals refer to similar elements and in which.

DETAILED DESCRIPTION

Figure 1A:
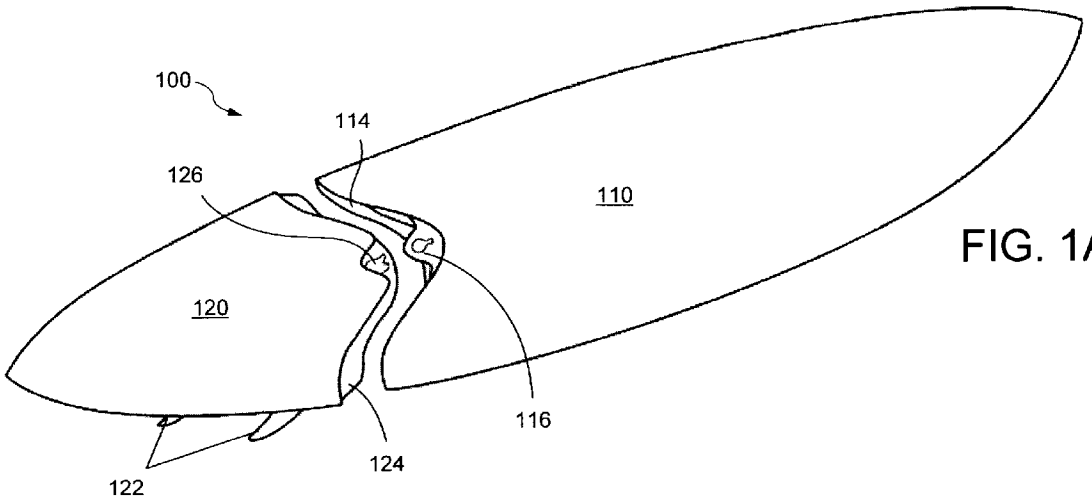
FIGS. 1A and 1B illustrate an embodiment of a segmented surfboard with a flexible connector interface.

A segmented surfboard is disclosed that can be disassembled and reassembled for convenient transportation and/or storage. More specifically, a surfboard system in accordance with present embodiments includes head and tail segments that can be interchanged with other corresponding segments using an interface system to create a custom surfboard assembly. By using interchangeable head and tail segments, the performance characteristics of the surfboard may be customized to suit a user's needs under various levels of experience and/or surf conditions.

For some embodiments, the relative lengths of the surfboard segments are designed to allow a high level of customizability for the surfboard. More specifically, the connection interface between the head and tail segments is formed at a location along a length of the surfboard that allows a wide variety of head/tail configurations. The interface system includes a pivoting locking mechanism that removably attaches the head and tail segments together using a cinching action having a tension moment substantially collinear with the axis of the surfboard while allowing the segments to flex relative to one another. For some embodiments, the pivoting locking mechanism is disposed along a central axis of the board, thereby distributing the load from the outer edges of the board to the center of the board. Alternatively, one or more pivoting locking mechanisms can be may be disposed along the rails (e.g., outer edges) of the surfboard, with at least one locking mechanism located along either edge of the surfboard to lock in each rail and further distribute forces toward the center of the board and/or along the rails.

Other embodiments describe a twisting interleaved connection interface between surfboard segments. The twisting interleaved connection interface allows stress at the interface to be distributed substantially evenly across both the head segment and tail segment. Additionally, the twisted interface may help guide the segments of the surfboard into a locking (or interlocking) position with one another to form a completed surfboard assembly.

The terms "user" and "rider" may be used herein interchangeably to refer to anyone who uses the segmented surfboard in an intended manner (e.g., surfing). Although specific reference is made herein to a segmented surfboard, it should be noted that the techniques and embodiments disclosed herein may be applied to waterboards in general (e.g., bodyboards, kiteboards, skimboards, wakeboards, etc.). Furthermore, one of ordinary skill in the art will appreciate that the techniques and embodiments disclosed herein may be used to improve the portability and/or customizability of boards used in other types of board sports (e.g., skateboards, snowboards, etc.) with little or no modification.

Several of the embodiments in this disclosure describe a segmented surfboard composed of a head segment and a detachable tail segment. The tail segment may be detached to provide greater convenience in storing or transporting the surfboard. In addition, the tail segment may be interchanged for other tail segments having different performance characteristics. This affords a user the same (or at least similar) performance and/or customization benefits of having multiple surfboards, while having to carry only one header segment along with a "quiver" (e.g., a plurality) of tail segments to a beach or surf destination. In addition, the connection interface and locking mechanism between the segments provide for improved flex and load distributions between the two segments, while also allowing a greater level of user customization and performance tuning of the surfboard.

Figure 1B:
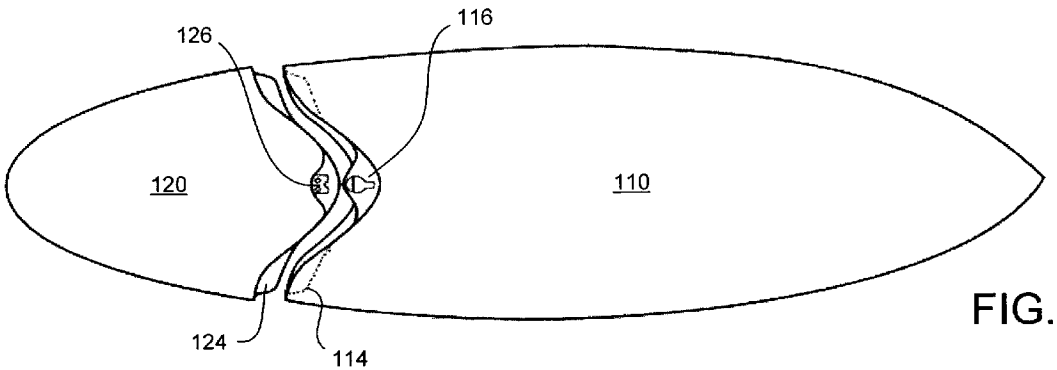
Figure 1C:
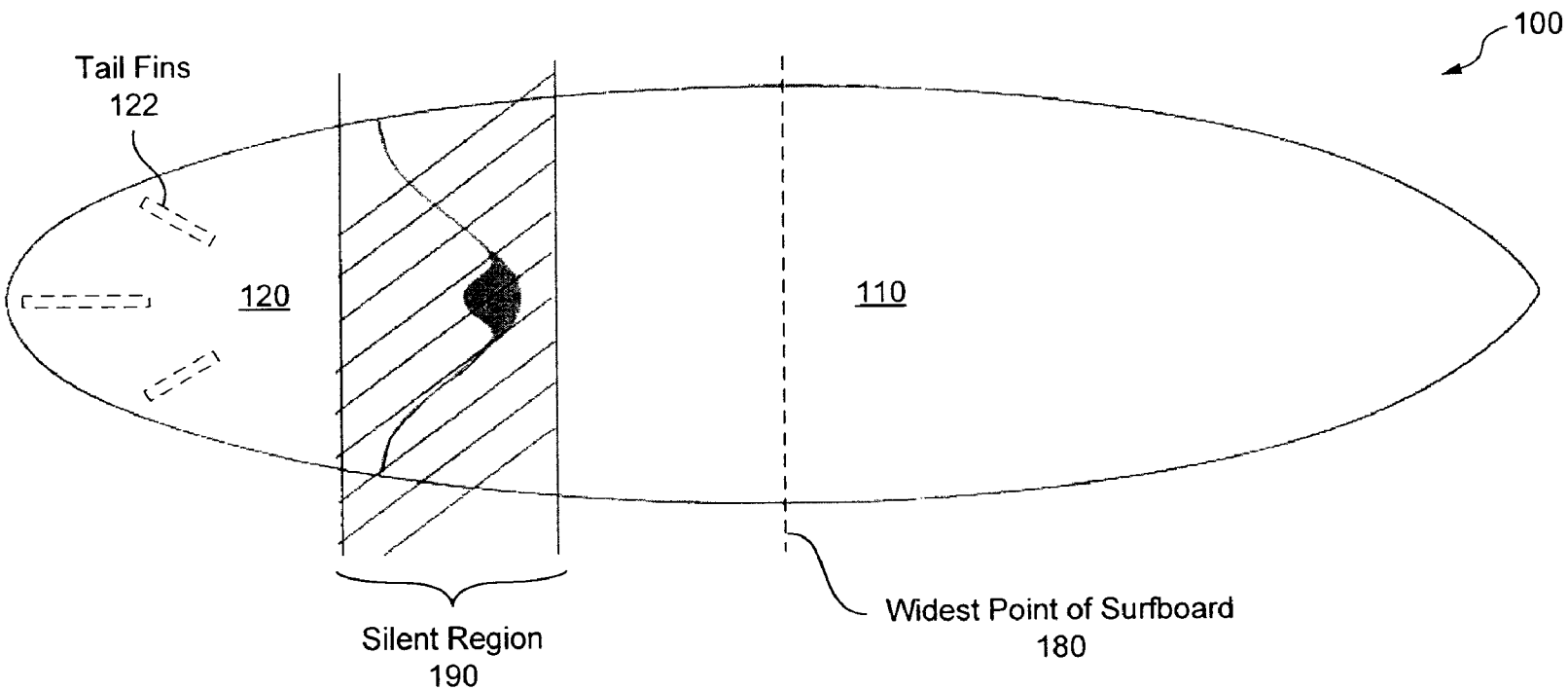
FIG. 1C shows a top plan view of the segmented surfboard of FIG. 1 in the closed or locked position.

FIGS. 1A and 1B illustrate an embodiment of a segmented surfboard 100 with a flexible connector interface. The segmented surfboard 100 includes a head segment 110 and a tail segment 120. For some embodiments, the head segment 110 is longer than the tail segment 120, and forms the main body of the surfboard. The overall size and/or shape of the head segment 110 may vary. For example, a longer head segment 110 may generally provide a more stable riding experience while a shorter head segment 110 may be more effective in cornering (e.g., making tight turns with the surfboard 100). Furthermore, the shape of the front tip (or "nose") of the head segment 110 may be more rounded or more pointed, for example, to improve the maneuverability or stability of the surfboard 100.

Although not shown, the curvature of the bottom surface of the head segment 110 may range from relatively flat to having a more convex (e.g., "rocker") curve, which may vary the handling characteristics of the surfboard 100. In addition, the bottom surface of the head segment 100 may include one or more grooves or ridges for directing water flow along the length of the board (e.g., toward the tail fins).

The head segment 110 may be composed of various types of material including, for example, a composite plastic skin laminated with fiberglass, wood, carbon fiber, or similar material. Furthermore, the head segment 110 may be either hollow or filled with a buoyant material (e.g., wood or foam). It should be noted that the material composition of the head segment 110 may affect the weight and/or durability of the surfboard 100. For some embodiments, the head segment 110 may include one or more structural elements (e.g., "stringers") for improved strength and flexibility and/or for controlling the weight distribution of the surfboard 100.

In general, the majority of differences among surfboards are a result of variations in the rear, or tail, of the surfboard. For some embodiments, the tail segment 120 is shorter in length than the head segment 110. This allows a user to carry multiple tail segments 120 for each head segment 110, which provides the benefits of having multiple surfboards on hand (e.g., while traveling) without substantial sacrifice in size and weight.

Figure 10:
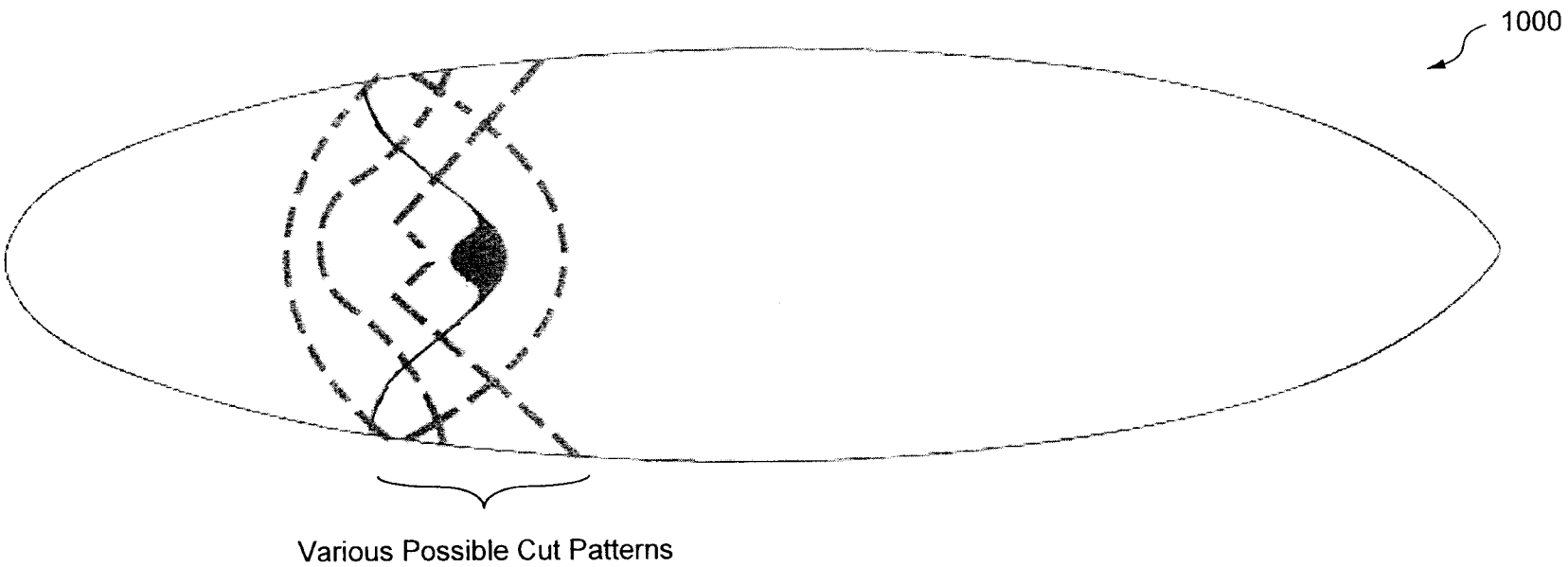
FIG. 10 illustrates an exemplary segmented surfboard showing various possible cut patterns.

For some embodiments, the relative length of the tail segment 120 is also a result of "splitting" the surfboard 100 within a "silent region" of the board. As shown in FIG. 10, the silent region 190 is typically located in an area between the widest point 180 (which may be the midpoint) of the surfboard 100 and the tip of the tail (e.g., where one or more tail fins 122 and/or other features are located). The silent region corresponds to a section in which the outline of the surfboard undergoes the least amount of change (e.g., in thickness, width, and/or curvature). In other words, differences in geometry between various tail segments 120 (and/or head segments 110) become primarily noticeable beyond this silent region 190.

For example, the characteristic differences in typical unibody surfboards having various tail configurations (e.g., pin tail, swallow tail, fish tail, etc) are typically found in one or more areas outside of the silent region. Segmenting the surfboard within the silent region 190 reduces (or minimizes) the differences in geometry between the head segment 110 and the tail segment 120 at the connection interface, and thus allows for smoother (e.g., seamless) transitions between the two segments for a wide variety head/tail combinations. According to an embodiment, splitting the surfboard 100 within the silent region 190 allows for an optimal level of interchangeability between the head segment 110 and various tail segments 120 (and/or vice-versa).

Figure 1D:
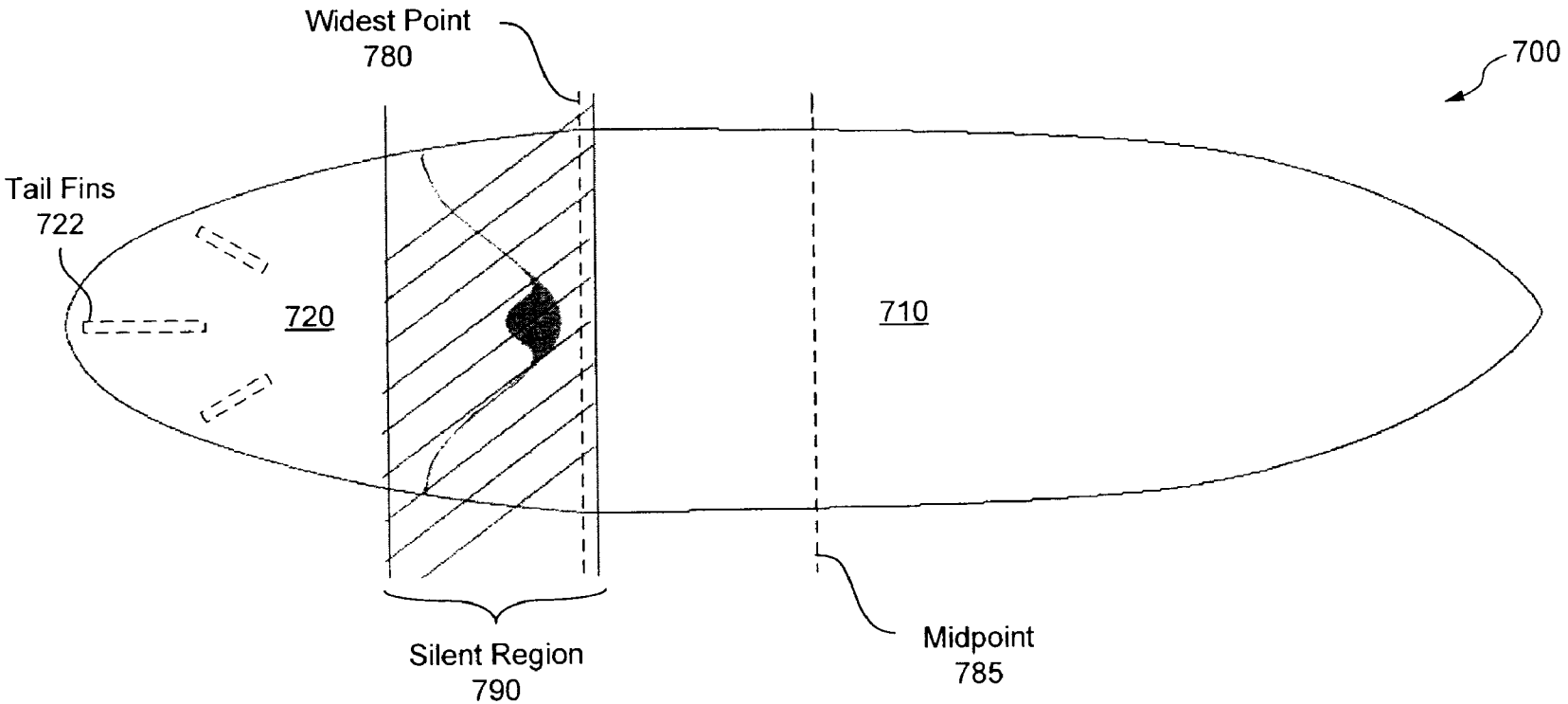
FIG. 1D illustrates another embodiment of a surfboard, wherein the widest point of the surfboard is different than its midpoint.

In the example of FIG. 10, the widest point 180 of the surfboard 100 also corresponds to the midpoint of the board. However, this may not always be the case. For example, depending on the type and/or design of surfboard, the widest point may be located at a point closer to either the tail or the head of the surfboard. FIG. 1D illustrates another embodiment of a surfboard 700, wherein the widest point 780 of the surfboard is different than the midpoint 785. In the specific example shown, the widest point 780 is located between the midpoint 785 and the tail segment 720, thus falling within the silent region 790 of the surfboard 700. Thus, for alternative embodiments, the silent region 190 is located between the midpoint (which may not be the widest point) of the surfboard 700 and the tip of the tail (e.g., where one or more tail fins 722 and/or other features are located).

The overall size and/or shape of the tail segment 120 may also vary. As with the nose of the head segment 110, the rear tip of the tail segment 120 may also have a unique shape or contour to affect the flow of water beneath the tail of the surfboard 100. For example, the rear tip may have a rounded edge (e.g., "pin tail"), a blunt edge (e.g. "squash tail"), or a forked edge (e.g., "swallow tail") configuration. The curvature of the bottom surface of the tail segment 120 may range from relatively flat to having a rocker curve (e.g., similar to that of the header segment 110).

The tail segment 120 may be composed of various types of material (e.g., similar to those described above with respect to the head segment 110). The tail segment 120 may also be hollow or filled with a buoyant material. It should be noted that the material composition of the tail segment 120 may be different from the material composition of the corresponding head segment 110, to provide the surfboard 100 a more customized weight and feel. For some embodiments, the head segment 110 and/or the tail segment 120 can include one or more stringers (or rods) for distributing forces evenly across the surfboard 100 and for controlling the strength and/or flex of the board. As shown with respect to FIGS. 1E-1J, the stringers 115 and 125 can be disposed in a number of different configurations throughout the length (and/or width) of the surfboard 100.

Figure 1E:
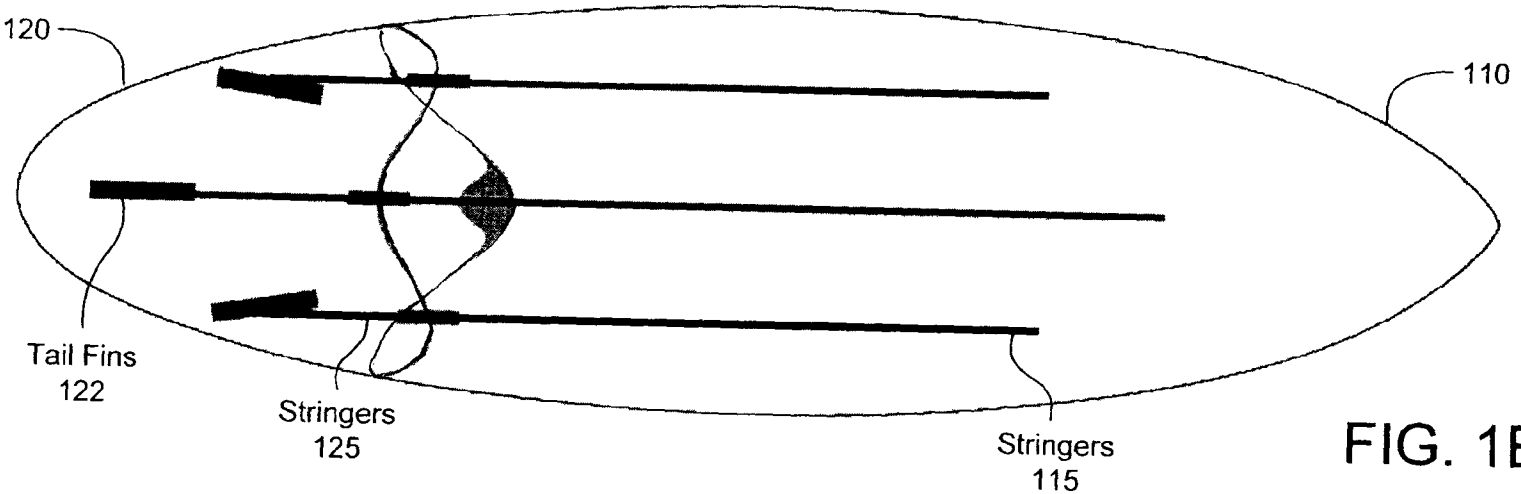
FIGS. 1E-1J illustrate various embodiments of stringer configurations for a segmented surfboard.

FIG. 1E illustrates a stringer configuration wherein the stringers 125 in the tail segment 120 and corresponding stringers 115 in the head segment 110 are substantially straight and parallel to one another. Each of the three stringers 115 in the head segment connects to and thus combines with a corresponding stringer 125 in the tail segment 120 to provide a substantially linear support structure across the length of the surfboard.

Figure 1F:
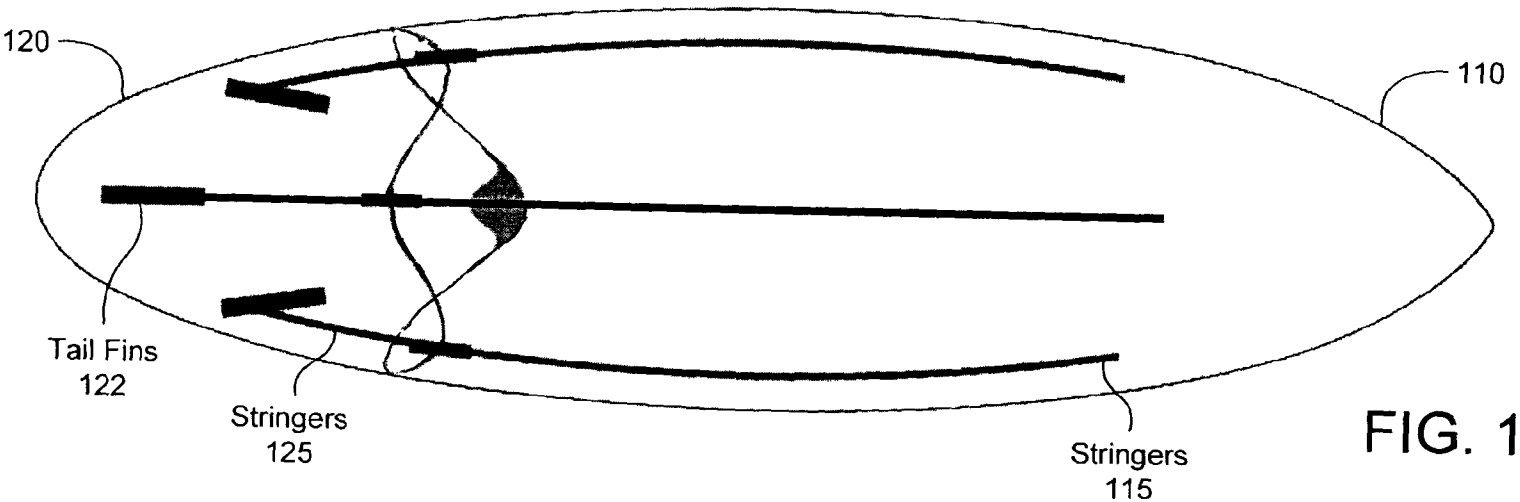

FIG. 1F illustrates a stringer configuration wherein the stringers 125 and 115 running across the center of the board are substantially straight, while the outermost stringers 125 and 115 (e.g. closest to the rails of the surfboard) are curved to substantially coincide with the outer shape or curvature of the surfboard. Accordingly, the outermost stringers may help provide additional structure support along the outer edges or rails of the surfboard, while the middle stringers provide a substantially linear support down the length of the board.

Figure 1G:
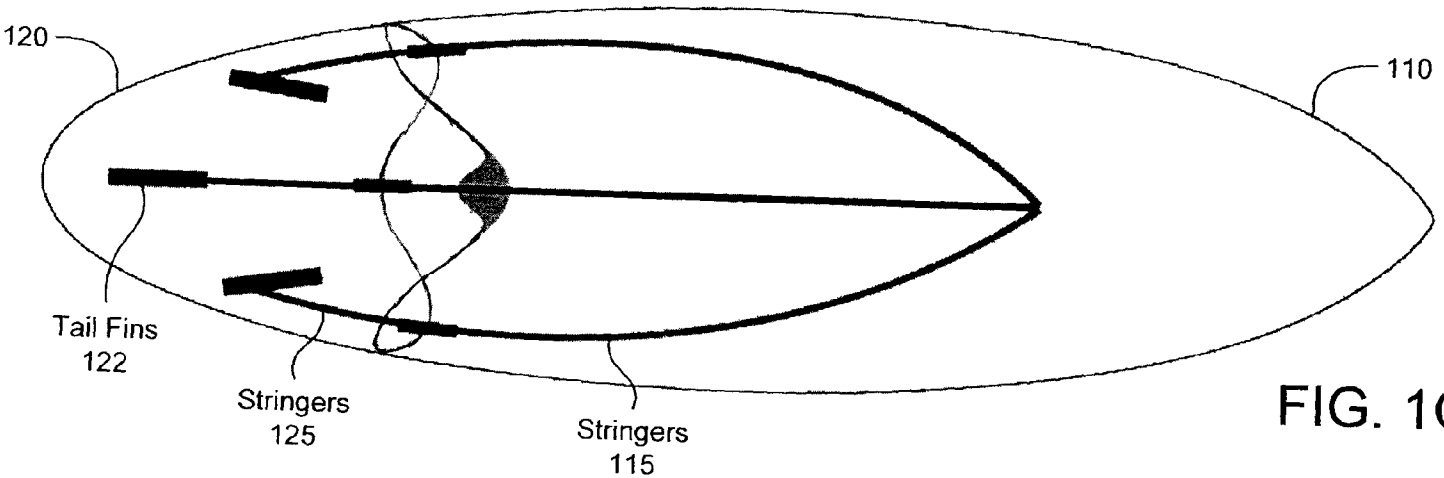

FIG. 1G illustrates a stringer configuration wherein the center stringers 125 and 115 are straight and the outer stringers 125 and 115 are curved. In this embodiment, all three stringers 115 in the head segment intersect one another (and thus terminate) at a single point in the head segment 110.

Figure 1H:
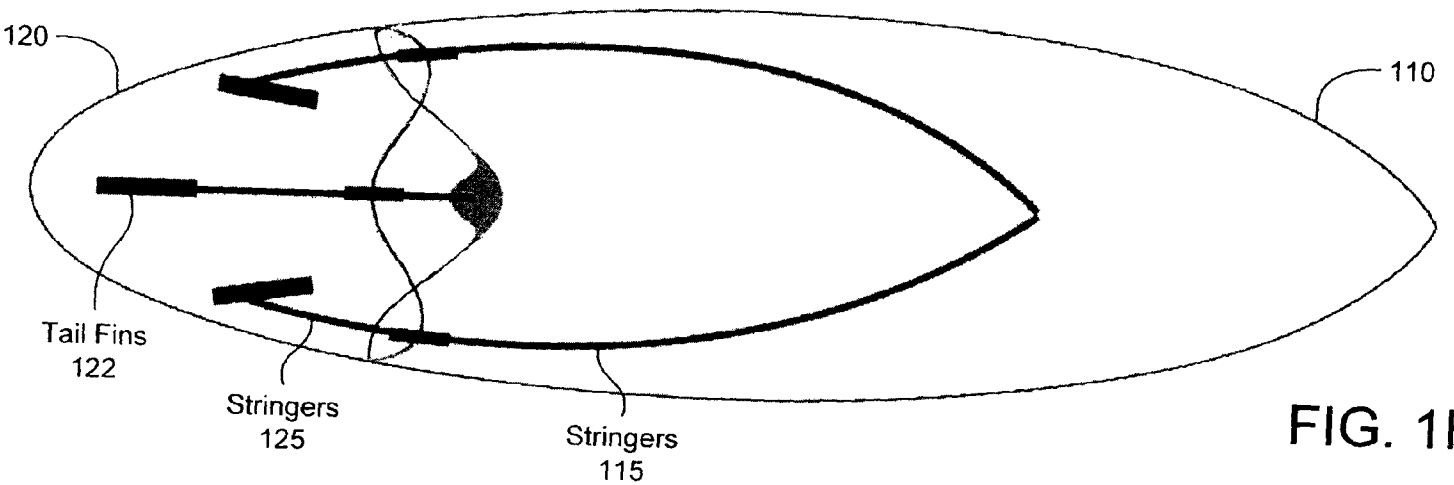

FIG. 1H illustrates another stringer configuration wherein the center stringers 125 and 115 are straight and the outer stringers 125 and 115 are curved. However, in this embodiment, the center stringer 115 in the head segment 110 runs only a short length along the central axis of the board. Thus, only the two outer stringers 115 in the head segment 110 intersect each other.

Figure 1I:
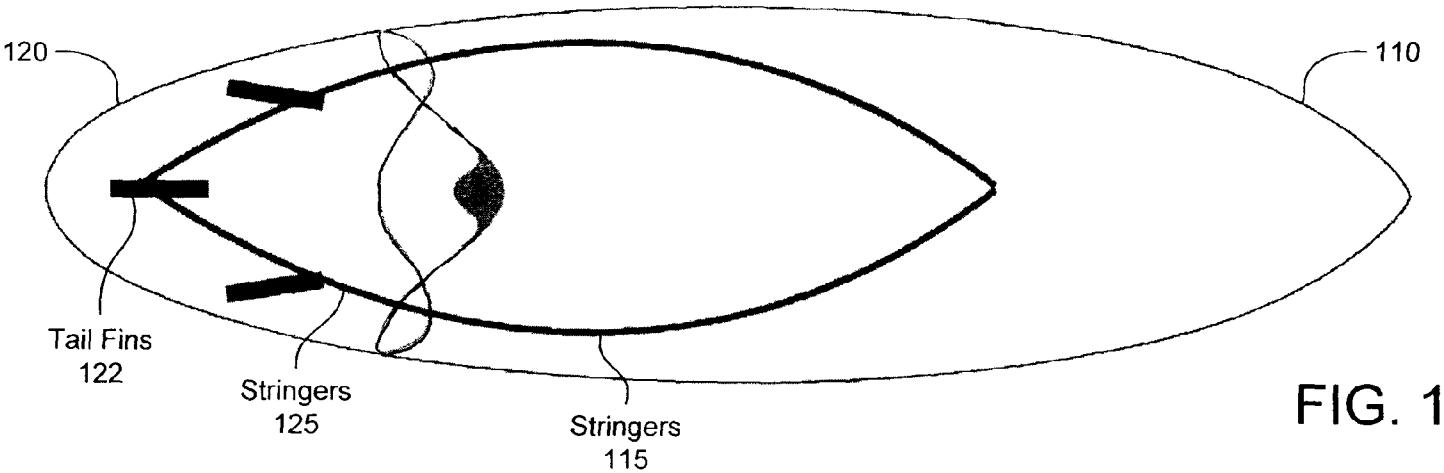

FIG. 1I illustrates a stringer configuration including only two curved stringers 125 and 115 in each of the tail segment 120 and the head segment 110, respectively. In this embodiment, the stringers 115 intersect (and thus terminate) at a certain point in the head segment 110, and the stringers 125 also intersect at a certain point in the tail segment 120.

Figure 1J:
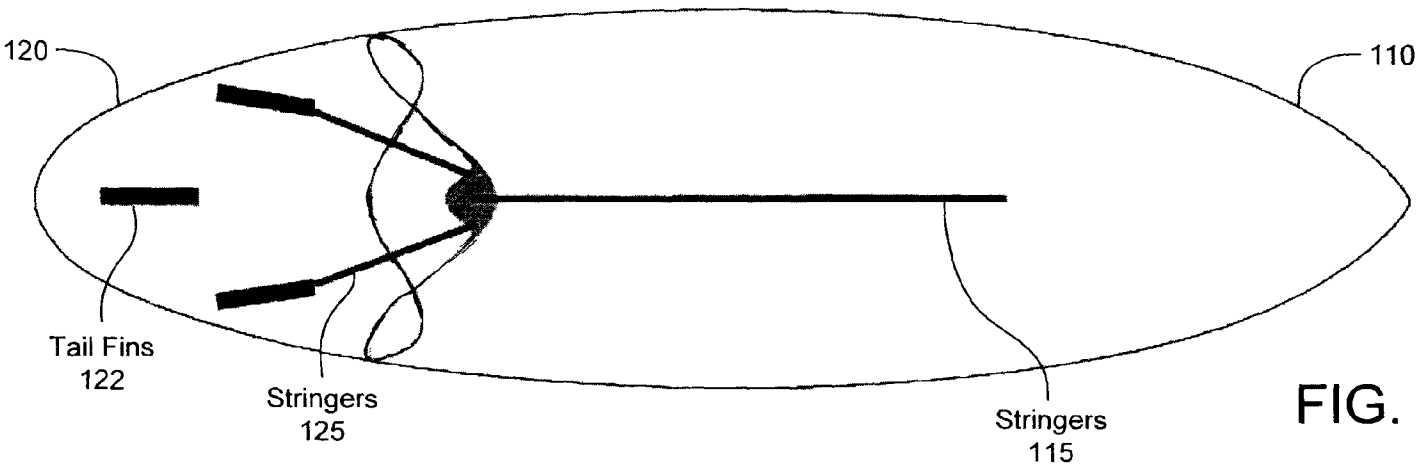

FIG. 1J illustrates a stringer configuration including two stringers 125 in the tail segment 120 and a single stringer 115 in the head segment 110. In this embodiment, the stringers 125 and 115 are all substantially straight. The stringer 115 simply runs down the center of the head segment 110. However, the stringers 125 start out relatively close to one another, at the intersection of the tail segment and the head segment 110, and fan out towards the rails of the tail segment 120.

In the configurations described above, the stringers 125 and 115 can help distribute forces from the rails of the surfboard towards the center of the board. The various possible configurations allow a rider to more precisely tune the surfboard to have different flex characteristics, and to "even out" the forces applied to the board to affect how the board behaves under the particular rider's weight. For example, in certain embodiments where the stringers 115 do not extend all the way across the head segment 110, there may be less swing weight in the front as the board is turned under surf conditions.

Although three sets of stringers (e.g., in each of the head segment and tail segment) are shown in most of the embodiments described above, other embodiments may include more or fewer sets of stringer elements. Furthermore, the stringer configurations in the head and/or tail segments for some of the embodiments above may be interchangeable. For example, a tail segment having a certain stringer configuration shown in one of the FIGS. 1E-1J may be combined with a head segment having a different stringer configuration shown in a another one of the FIGS. 1E-1J.

Referring again to FIG. 1A, the bottom surface of the tail segment 120 may further include one or more fins 122, which affect the maneuverability of the surfboard 100. The fins 122 may vary in shape, size, material composition, and/or placement (i.e., location on the tail segment 120). For some embodiments, the bottoms surface of the tail segment 120 may include one or more channels (or grooves) for guiding and/or directing the flow of water across the bottom of the board.

A connector interface 124 of the tail segment 120 connects to a corresponding connector interface 114 of the head segment 110. The edges of the connector interface 114 are contoured to the edges of the connector interface 124 to form a seal at the intersection of the head segment 110 and the tail segment 120. Additionally, the contoured edges may serve to align the rails (e.g., the outer edges of the surfboard) for a proper fit.

For some embodiments, the edges of the connector interfaces 114 and 124 are non-linear. For example, as shown in FIGS. 1A and 1B, the edges of the connector interfaces 114 and 124 form a substantially "v" (or "u") shape. This may help guide the tail segment 120 into proper alignment with the head segment 110 when assembling the surfboard 100. In addition, the "v" shape interface edges help to distribute forces (e.g., rider weight) from the edges of the surfboard 100 to its center (e.g., lengthwise, along the central axis of the surfboard). The non-linear edges of the connector interfaces 114 and 124 may also help to control the manner in which the tail segment 120 is able to flex (or "vibrate") relative to the head segment 110.

It should be noted that there may be various other ways to "cut" the surfboard (e.g., to produce the connector interfaces of the head and tail segments) in a non-linear fashion that will still achieve the intended benefits described above. FIG. 10 illustrates an exemplary segmented surfboard 1000 on which various possible cut patterns are drawn.

The connector interfaces 114 and 124 may be constructed of a different material than the rest of the surfboard 100. According to an embodiment, the connector interfaces 114 and 124 are made of an elastomeric material (e.g., rubber), in order to facilitate a better connection between the head segment 110 and the tail segment 120. For example, rubber surfaces have higher coefficients of friction, and may thus help maintain a more stable connection or seal between the tail segment 120 and the head segment 110 when in contact with water (e.g., by preventing the segments of the surfboard 100 from slipping or sliding around at the connection interface). Additionally, the elastomeric material may help dampen or absorb any forces on the connector interfaces 114 and 124, thus improving the overall durability of the surfboard 100.

The stiffness of the elastomeric material used to construct the connector interfaces 124 and/or 114 may vary, depending on the desired amount of flex in the tail segment 120. This allows the surfboard 100 to be further tuned to a rider's height, weight, skill level, and/or handling preference. For example, to limit the flexibility between segments of the surfboard only one of the connector interfaces 124 or 114 may be composed of the elastomeric material. To allow even greater flexibility, both of the connector interfaces 124 and 114 may be constructed of an elastomeric material, however, the stiffness of the material used in the connector interface 124 may differ from that of the connector interface 114.

For some embodiments, the connector interfaces 124 and 114 may be formed from a relatively stiff material (e.g., fiberglass, carbon fiber, wood, injection molded plastic, etc.) that is similar, if not identical, to the material used to construct the body of the surfboard 100 (i.e., the majority of the tail segment 120 and head segment 110, respectively). This may help maintain the overall structural integrity of the surfboard 100 and provide a riding experience that is substantially similar to that of a unibody surfboard. Additionally, a layer of elastomeric material may be disposed on top of the connector interfaces 124 and 114 (e.g., where the connector interfaces 124 and 114 make contact with one another) to form a tight seal, and to absorb vibrations and/or flex between the surfboard segments.

According to another embodiment, portions of the connector interface 124 extend beyond a surface, or shell, of the tail segment 120 and connect to corresponding grooves or slots of the connector interface 114 (e.g., depicted in FIG. 1B by dotted lines). Specifically, the connector interface 124 includes two "male" connector features that extend in a lengthwise direction, along the width of the tail segment 120, while the connector interface 114 includes two corresponding "female" connector features to receive (i.e., form a connection with) the connector interface 124. Interlocking the widths of the head segment 110 and the tail segment 120 further helps to distribute forces applied to the surfboard 100 (e.g., from the outer edges of the board to the center of the board), as well as to align (and lock) the head segment 110 with the tail segment 120 to form the completed surfboard assembly 100.

The male-female interconnection of the connector interfaces 124 and 114 allows the surfboard 100 to have a flush (or substantially "seamless") surface at the intersection of the head segment 110 and the tail segment 120. For example, the connector interfaces 114 and 124 may be substantially hidden from view (i.e., beneath the outer shell of the surfboard 100) when the tail segment 120 is attached to the head segment 110. For some embodiments, the entire tail segment and/or head segment (e.g., including the outer shell, inner filling, and connector interface) may be molded as one piece, thus streamlining the manufacturing process.

The "overlapping" elastomeric connector interfaces, 124 and 114, facilitate the flexing of the tail segment 120 relative to the head segment 110, while also maintaining the structural integrity of the surfboard 100 along the edges (i.e., width) of the interface between the head segment 110 and the tail segment 120. According to an embodiment, the amount of overlap between the head segment 110 and the tail segment 120 (i.e., the length of protrusion of the connector interface 124 and/or the depth of the corresponding grooves of the connector interface 114) may vary for alignment and/or attachment purposes, as well as to allow for different amounts of flex between the head segment 110 and the tail segment 120.

The head segment 110 further includes a latching mechanism 116 for latching (or "locking") the head segment 110 to the tail segment 120. Similarly, the tail segment 120 includes a corresponding latching mechanism 126 which forms a connection with the latching mechanism 116 on the head segment 110. According to an embodiment, the latching mechanisms 116 and 126 are disposed in the center of the connector interfaces 114 and 124, respectively. This adds structural support to the center of the interface between the head segment 110 and the tail segment 120, and effectively stabilizes the connection between the connector interfaces 114 and 124 across the entire width of the interface.

According to another embodiment, the latching mechanisms 116 and 126 may be designed to "pull" the two segments of the surfboard 100 together. This not only provides a more secure connection between the head segment 110 and the tail segment 120, but may also improve the flexibility of the tail segment 120 relative to the head segment 110 and may further alter the geometry (e.g., curvature or angle) of the surfboard 100, as will be described in greater detail below.

Figure 1K:
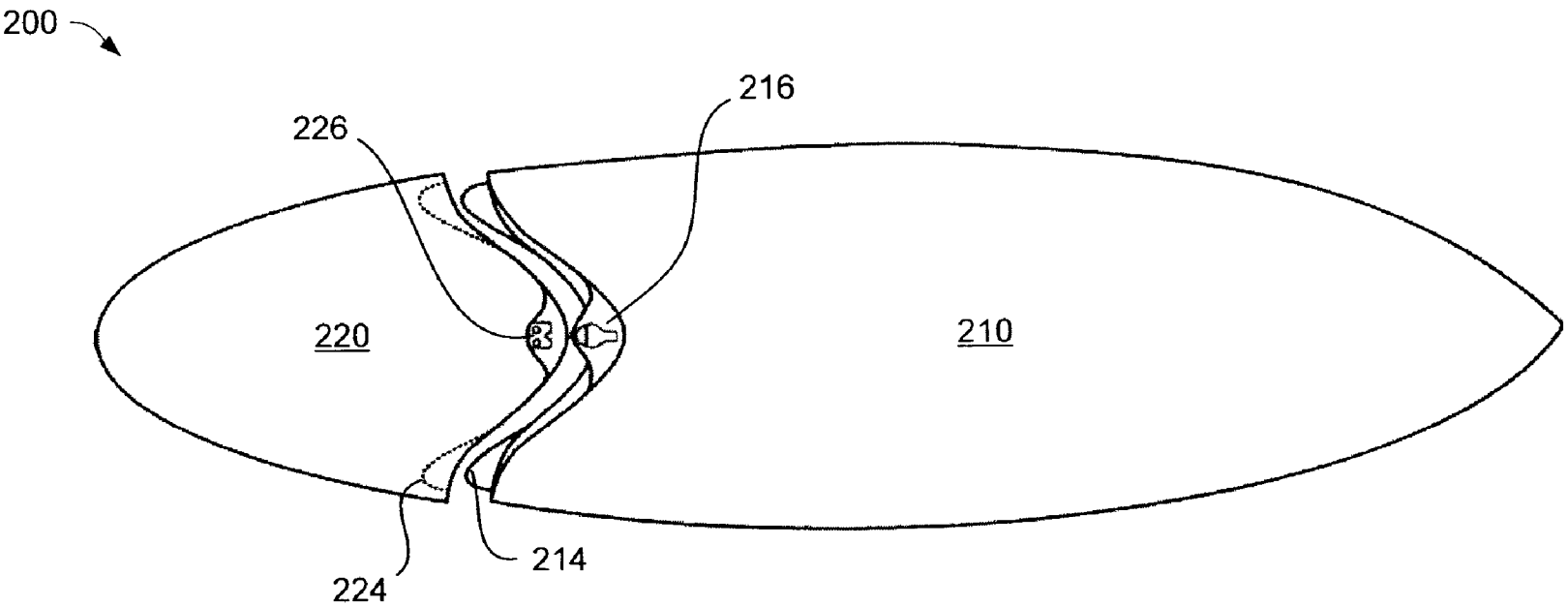
FIG. 1K illustrates another embodiment of a segmented surfboard with a flexible connector interface.

FIG. 1K illustrates another embodiment of a segmented 200 surfboard with a flexible connector interface. Specifically, the segmented surfboard 200 includes a head segment 210 and a tail segment 220. The head segment 210 includes a connector interface 214 and latching mechanism 216 which may be connected to a corresponding connector interface 224 and latching mechanism 226, respectively, on the tail segment 220 to form a complete surfboard assembly. The features of the segmented surfboard 200 may be substantially similar in function to corresponding (i.e., counterpart) features of the segmented surfboard 100, with the exception that the male connector features reside on the head segment 210 (i.e., as part of the connector interface 214), while the female connector features reside on the tail segment 220 (i.e., as part of the connector interface 224).

Figure 1L:
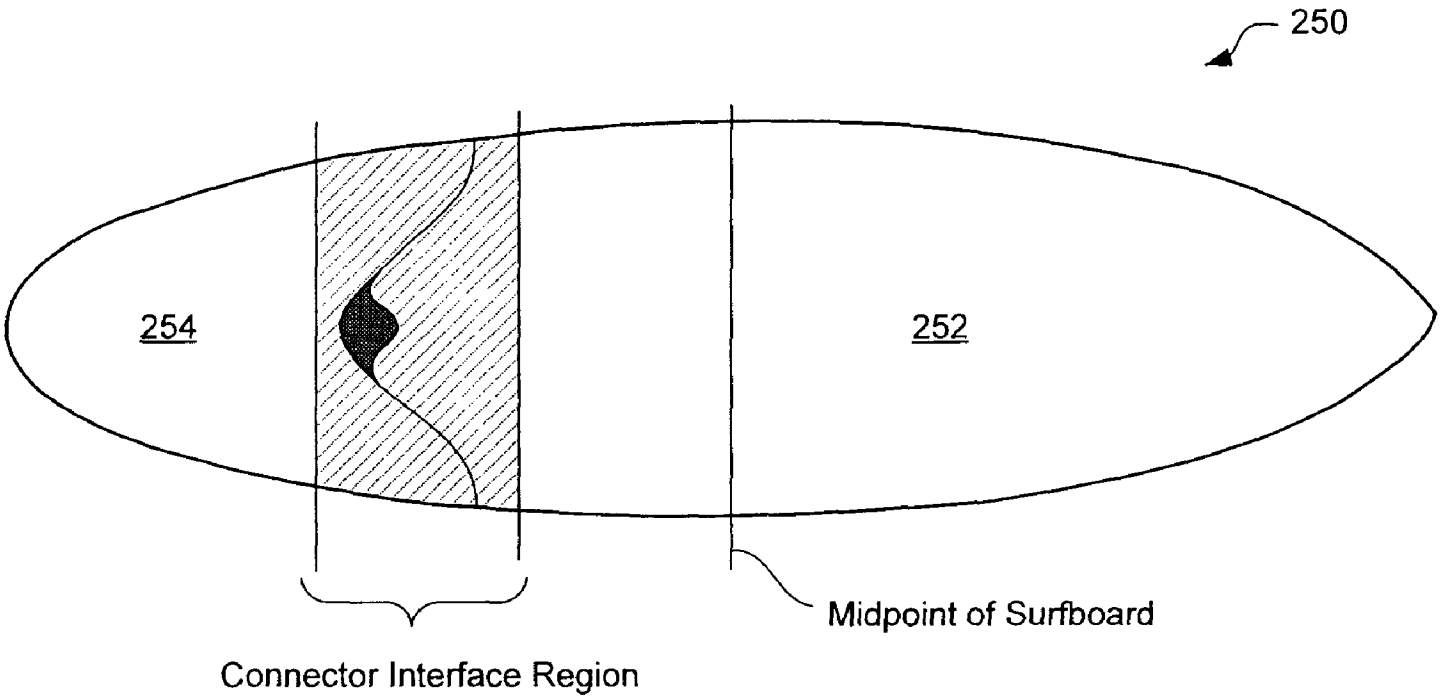
FIG. 1L illustrates yet another embodiment of a segmented surfboard with a flexible connector interface.

FIG. 1L illustrates yet another embodiment of a segmented surfboard 250 with a flexible connector interface. The segmented surfboard 250 may be substantially similar (e.g., in form and function) to any of the segmented surfboards discussed above with respect to FIGS. 1A-1K, with the exception that the connector interface now "points" toward the tail segment 254 rather than the head segment 252. More specifically, the connector interface edges of the head segment now form a "v" shape while the connector interface edges of the tail segment now form a corresponding "w" shape.

The embodiments described above provide a segmented surfboard with various means for controlling and/or adjusting the flexibility of the tail segment. This is an advantageous feature, as the flexible tail effectively forms a "variable" rocker curve along the underside of the surfboard. As described above, the amount of curve along the underside of the surfboard directly affects the precision of handling the surfboard. Thus, for example, increasing the amount of flex of the tail segment relative to the head segment (e.g., decreasing the rigidity or stiffness of the connector interfaces 124 and/or 114) may allow for tighter cornering on the water.

Figure 2B:
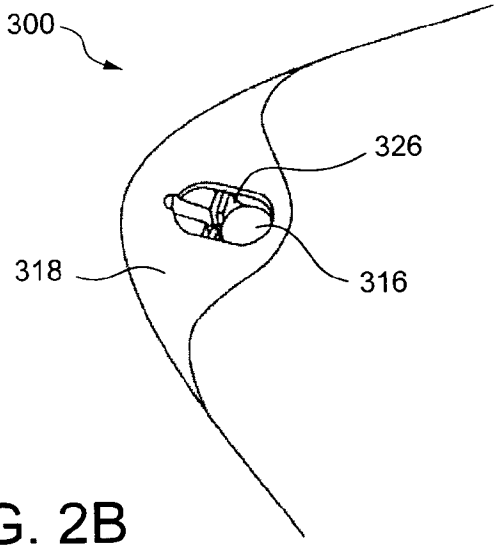
FIGS. 2A-2C are exploded perspective views of a latching mechanism for attaching the segments of a segmented surfboard, according to an embodiment.
Figure 2C:
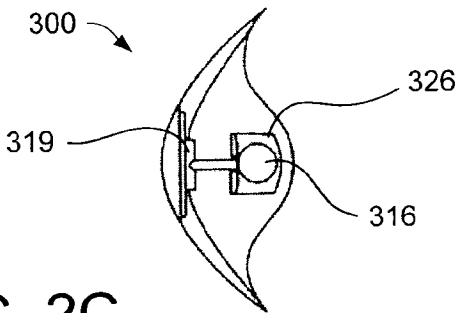
Figure 2A:
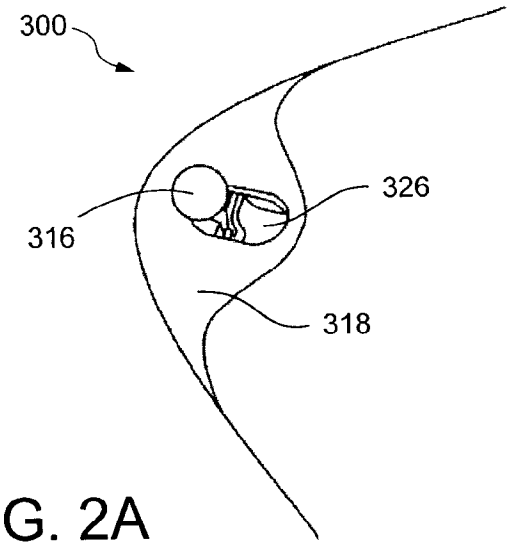

FIGS. 2A-2C illustrate a latching mechanism 300 for attaching the segments of segmented surfboards according to present embodiments. The latching mechanism 300 includes a hook feature 316 disposed on a surfboard segment and a corresponding latch fixture 326 disposed on a complementary surfboard segment. For purposes of discussion, it is assumed that the hook feature 316 is disposed on the head segment (e.g., head segment 110 in FIGS. 1A and 1B) of a segmented surfboard, and the latch fixture 326 is disposed on the tail segment (e.g., tail segment 120). In alternative embodiments, however, the hook feature 316 may be included on the tail segment while the latch fixture 326 is included on the head segment.

FIG. 2A shows the latching mechanism 300 in an open (i.e., "unhooked" or "unlocked") state. A flexible pod 318 covers the interface lever assembly 319 and acts as a partial barrier to the hook feature 316 and latch fixture 326. For example, the flexible pod 318 may protect the hook feature 316 from being accidentally unhooked from the latch fixture 326 by external forces (e.g., ocean current, debris, a rider's foot, etc.). The flexible pod 318 may be attached to the head segment and contoured to cover at least a portion of the connector interface of the tail segment when the surfboard is in an assembled state. For some embodiments, the flexible pod 318 includes a hole or opening through which the hook feature 316 may be manually released or unhooked from the latch fixture 326.

In other embodiments, the flexible pod 318 is assembled in a manner that does not limit the flexibility of the tail segment relative to the head segment. For example, the flexible pod 318 may be composed of an elastomeric material (e.g., rubber) that will take vibrations and flex. The hardness of the elastomeric material forming the pod 318 may determine the amount of flex in the tail, and thus alter the rocker curve of the surfboard. Accordingly, the flexible pod 318 may be customized to match a rider's weight, skill level, and/or surf conditions. For example, when riding smaller waves, it may be desirable to increase the rocker curve of the surfboard in order for the tail to coincide with the larger "radius" of the wave pocket which the board rides in.

FIGS. 2B and 2C show the hook feature 316 and the latch fixture 326 in a closed (e.g., "hooked" or "locked") state. The hook feature 316 is pivotally attached to the head segment via an interface lever assembly 319. To secure the tail segment to the head segment, the interface lever 319 may be lowered into a receiving slit or groove in the latch fixture 326. The interface lever 319 helps to spread the tail load evenly to the front of the surfboard, through its point of connection to the head segment. For some embodiments, the interface lever 319 is a metal (e.g., steel) rod that is pivotally connected to the head segment. Alternatively, the interface lever 319 may be made from a flexible cord (e.g., constructed out of plastic, polymer, fabric, and/or metal) that is able to bend in relation to forces applied to and/or between the tail and head segments.

At least part of the hook feature 316 is wider than the interface lever 319, and thus "hooks" into the latch fixture 326 when the interface lever 319 is lowered into a locked position. For some embodiments, the hook feature 316 is a ball, or similarly shaped object, which may rotate or pivot while remaining hooked to the latch fixture 326. This allows the tail segment to flex or bend while being attached to the head segment.

The hook feature 316 can be a "screw-on" object attached to the end of the interface lever 319. The screw-on object may be in the shape of a ball or sphere (as previously described), or alternatively the object may be a simple screw-on bolt. The hook feature 316 may thus be fastened to the latch fixture 326 to form a tighter connection by rotating (or "screwing down") the hook feature in a first (e.g., clockwise) direction once it is in a locked (or interlocked) position over the latch fixture 326. Conversely, the hook feature 316 may be loosened from the latch fixture 326 by rotating (or "unscrewing") the hook feature in an opposite (e.g., counter-clockwise) direction.

How tightly the hook feature 316 is fastened to the latch feature 326 may directly affect how much the surfboard segments are able to bend or flex in relation to one another. For example, a greater amount of tension may reduce the flexibility of the segments while less tension may allow for more flex between the segments. Furthermore, the interface lever 319 may pivot with the amount of tension in the hook feature 316, thus altering an angle of the bottom surface of the surfboard. In alternative embodiments, two or more sets of latching mechanisms 300 may be used to connect the surfboard segments together (e.g., one along each rail or outer edge).

Figure 3A:
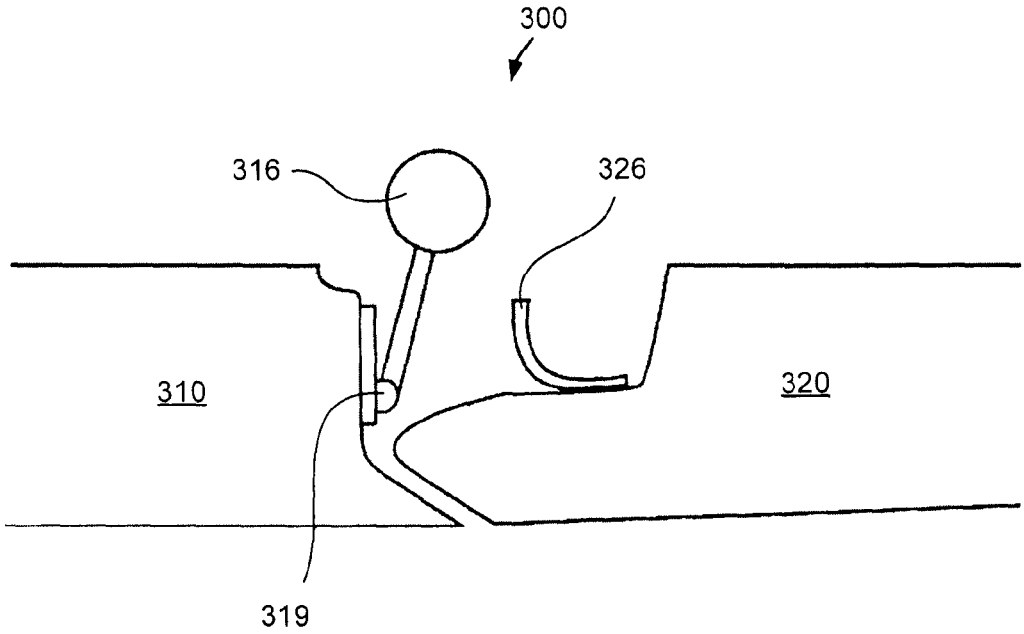
FIGS. 3A-3C are cross-sectional views of the latching mechanism shown in FIGS. 2A-2C.
Figure 3B:
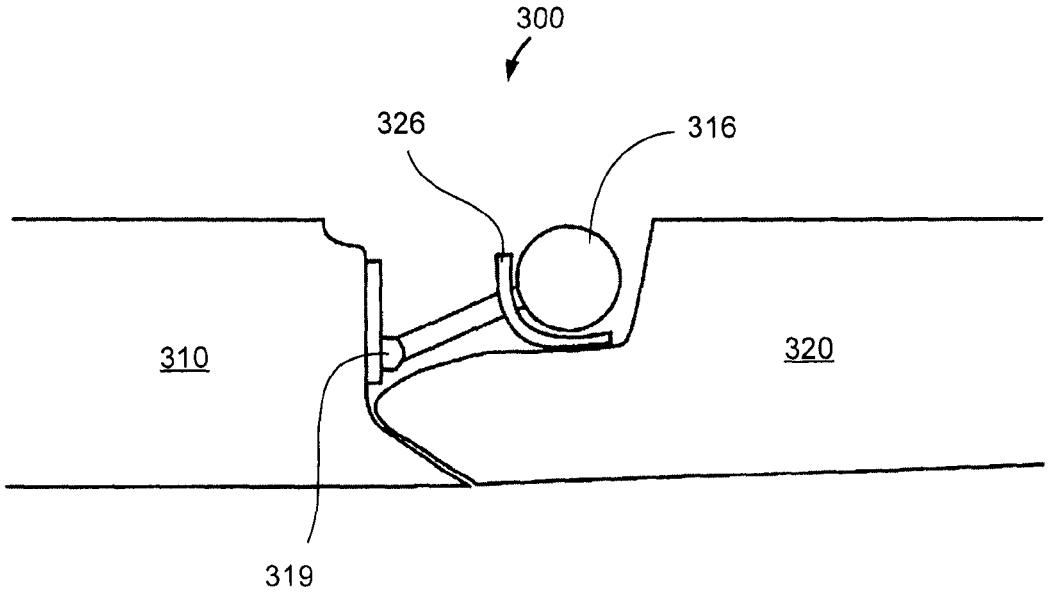

FIGS. 3A and 3B illustrate cross-sectional views of the latching mechanism 300 shown in FIGS. 2A-2C. The embodiments of FIGS. 3A and 3B show an interface lever assembly 319, including a hook feature 316, disposed on a surfboard segment 310. A corresponding latch fixture 326 is disposed on a complementary surfboard segment 320. For purposes of discussion, it is assumed that the surfboard segment 310 corresponds to a head segment of a segmented surfboard, whereas surfboard segment 320 corresponds to the tail segment. Of course, for other embodiments, the surfboard segment 310 can correspond to the tail segment, and surfboard segment 320 can correspond to the head segment.

FIG. 3A shows the latching mechanism 300 in an open or unlatched state. The interface lever 319 is in an "up" position, causing the hook feature 316 to be unhooked from the latch fixture 326. According to an embodiment, the interface lever 319 connects to the head segment 310 via a vertical hinge, and thus is able to pivot in only two directions (i.e., up or down). This provides a simple locking mechanism, as it allows the interface lever 319 to be easily lowered into (and raised from) a locked position. The pivotable interface lever 319 further allows the hook feature 316 to remain locked to the latch fixture 326 even as the geometry of the surfboard changes (e.g., while the tail segment 320 bends in relation to the head segment 310).

The latch fixture 326 is formed in the shape of an "L", according to an embodiment. The bottom surface of the latch fixture 326 is fastened or attached to the tail segment 320. Alternatively, the bottom surface of the latch fixture 326 may be at least partially integrated with the tail segment 320 (e.g., disposed beneath the top surface of the connector interface). The other end of the locking mechanism protrudes vertically (or at least substantially orthogonal) to the surface of the tail segment 320.

FIG. 3B shows the latching mechanism 300 in a closed or latched state. The interface lever 319 is in a "down" position, and rests within a slit or groove in the latch fixture 326. The hook feature 316 is substantially wide enough to prevent it from slipping through, or over, the slit in the latch fixture 326. The hook feature 316 hooks onto the edges of the latch fixture 326 and "pulls" the tail segment 320 in towards the head segment 310. According to an embodiment, the hook feature 316 is a ball, or similarly shaped object, which may rotate or pivot while in locked position with the latch fixture 326.

The shape of the hook feature 316, in conjunction with the hinged attachment of the interface lever 319 to the head segment 310, allows the tail segment 320 to flex or bend while remaining securely attached to the head segment 310. For example, regardless of how much the latch fixture 326 pivots about the hook feature 316, the hook feature 316 will continue to pull the latch fixture 326 (i.e., the tail segment 320) in toward the head segment 310. In addition, the vertically-hinged interface lever 319 allows the tail segment 320 to flex in a vertical direction, while also preventing the tail segment 320 from slipping or sliding in a horizontal direction. According to an embodiment, the latching mechanism 300 (i.e., the hook feature 316, interface lever 319, and latch fixture 326) is disposed in the middle of the interface between the head segment 310 and the tail segment 320, and further helps to distribute forces along the middle of the surfboard (e.g., as shown in FIGS. 2A-2C).

Figure 3C:
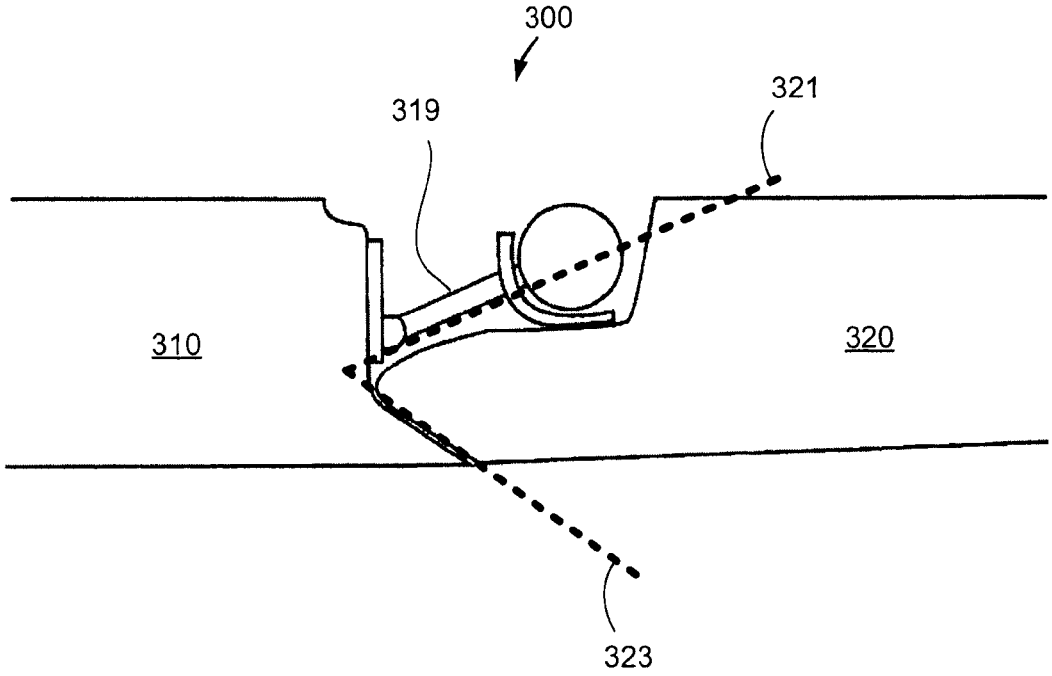

Referring back to FIG. 3A, it should also be noted that at least part of the tail segment 320 overlaps with the head segment 310 when in the locked state. For example, the overlapping portion of the head segment 310 functions to counteract the vertical component of the pulling forces exerted by the latching mechanism 300 on the tail segment 320, to prevent the tail segment from bending too far (in the vertical direction) or sliding out of lock with the head segment 310. As shown in FIG. 3C, the head segment 310 and tail segment 320 essentially form a "v" shape connection (e.g., illustrated by the intersecting lines 321 and 323) at the connection interface. Accordingly, forces applied by the latching mechanism 300 (e.g., along the line 321) are mitigated by forces applied by the overlapping tail segment 320 and head segment 310 (e.g., along the line 323). For some embodiments, the overlapping tail segment 320 and head segment 310 may serve to firmly lock the two segments together in a fixed (e.g., non-adjustable) surfboard configuration.

The amount of pull exerted by the hook feature 316 on the latch fixture 326 is adjustable to allow the user to further customize or fine tune the amount of flex in the tail segment 320. For example, once interface lever 319 is in a down position, and the hook feature 316 is in a locked state with the latch fixture 326, the hook feature 316 may be tightened (e.g., assuming it is screwed on to the interface lever 319) by turning or twisting the hook feature 316 with a finger or a wrench. Thus, the tighter the connection between the hook feature 316 and the latch fixture 326, the less the tail segment 320 is allowed to bend or flex (and vice-versa).

Additionally, the tighter the connection between the hook feature 316 and the latch fixture 326, the more the interface lever 319 will pivot. For example, still referring to FIG. 3C, increasing the tension in the hook feature 316 may "pull" the interface lever 319 to become more vertical with the plane of the surfboard, thus increasing the angle of the "v" shape formed by the intersecting lines 323 and 321. Meanwhile the hook feature 316, itself, simply rotates while remaining in a locked position with the latch fixture 326.

In one or more alternative embodiments, interface levers of various (fixed) lengths may be interchangeably attached to the head segment 310, to allow for various amounts of pull between the hook feature 316 and the latch fixture 326.

Figure 4A:
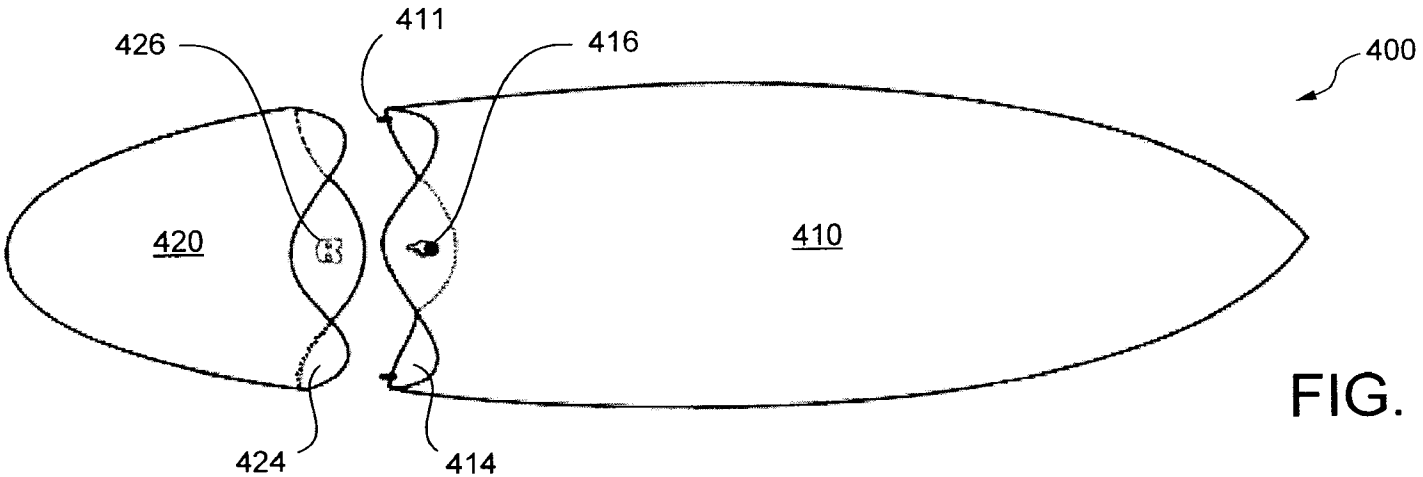
FIGS. 4A-4C illustrate an embodiment of a segmented surfboard with an interleaved connector interface.
Figure 4B:
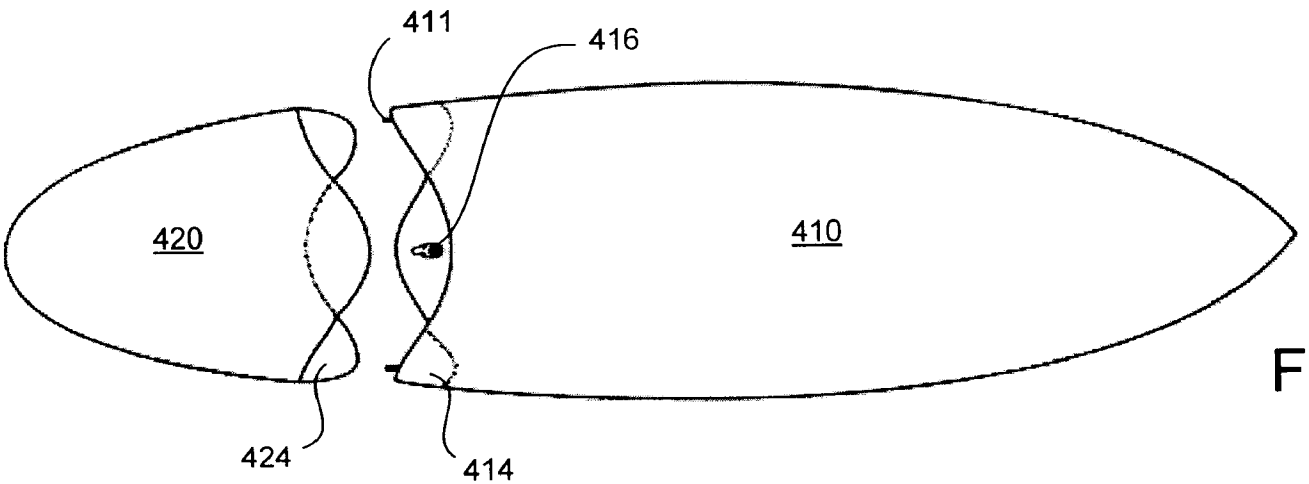
Figure 4C:
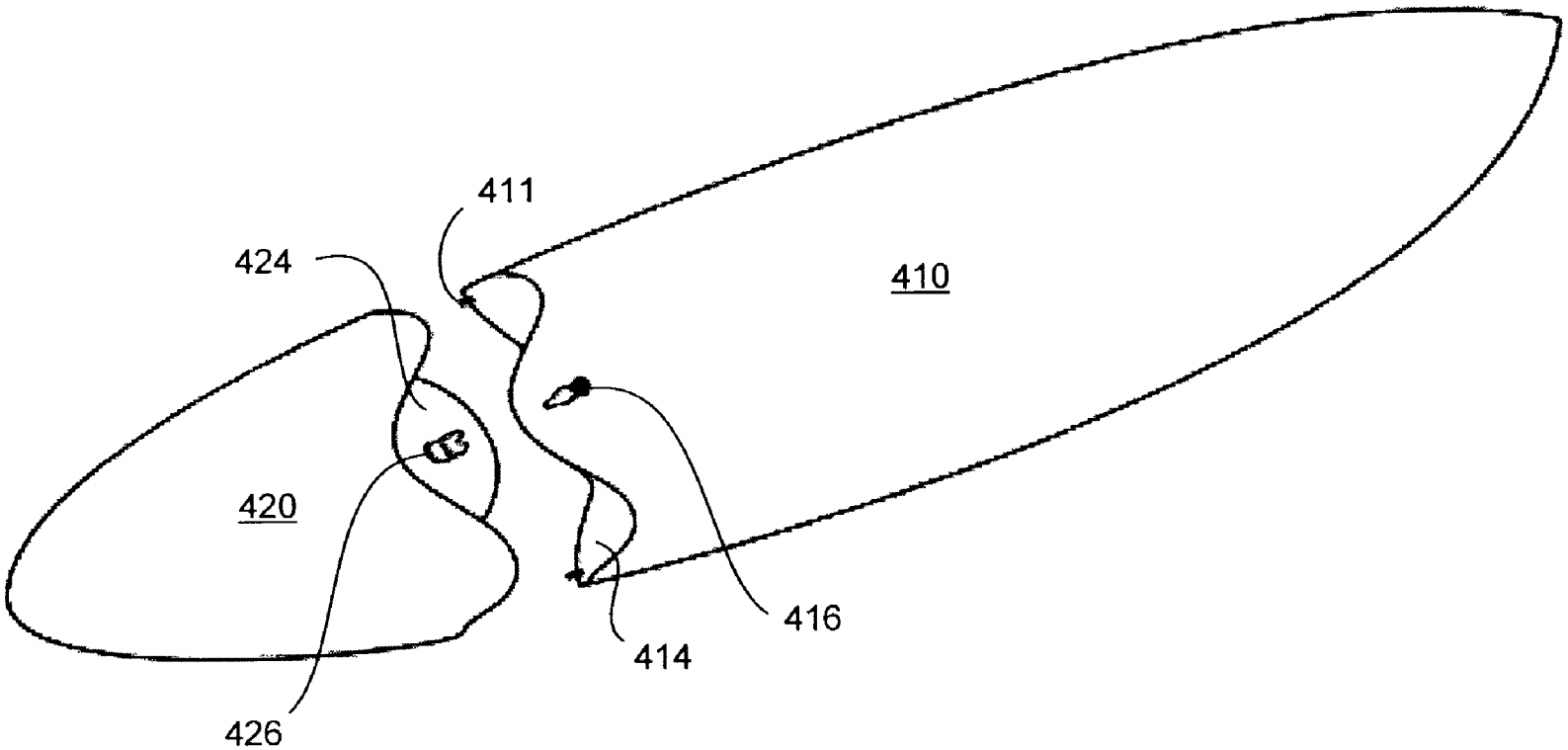

FIGS. 4A-4C illustrate an embodiment of a segmented surfboard with an interleaved connector interface. Specifically, FIGS. 4A, 4B, and 4C show top, bottom, and isometric views, respectively, of the segmented surfboard 400. The segmented surfboard 400 includes a head segment 410 and a tail segment 420. According to an embodiment, the head segment 410 is longer than the tail segment 420, however, the overall size and/or shape of the head segment 410 may vary (e.g., as described above with respect to FIGS. 1A and 1B).

A connector interface 424 of the tail segment 420 connects to a corresponding connector interface 414 of the head segment 410. The edges of the connector interface 414 are non-linear, and are contoured to the edges of the connector interface 424 to form a seal at the intersection of the head segment 410 and the tail segment 420. However, in contrast to the connector interfaces of the segmented surfboard 100, the connector interface 414 and 424 form an interleaved (or "twisted") shape. For example, each of the connector interfaces 414 and 424 includes both male and female connector features. For some embodiments, the total amount of overlap between each of the connector interfaces 414 and 424 is substantially equal. For example, the total surface area of the male connector features of the connector interface 414 may be substantially equal to the total surface area of the male connector features of the connector interface 424.

Referring to the top surface of the surfboard 400, as shown in FIG. 4A (and partially in FIG. 4C), the middle section of the connector interface 414 extends outward while the sides of the connector interface 414 recede inward, thus forming a "w" shape. Still referring to the top surface of the surfboard 400, the middle section of the connector interface 424 recedes inward while the sides of the connector interface 424 extend outward, thus forming a "v" shape.

Referring now to the bottom surface of the surfboard 400, as shown in FIG. 4B (and partially in FIG. 4C), the middle section of the connector interface 414 recedes inward while the sides of the connector interface 414 extend outward, thus forming a "v" shape. Still referring to the bottom surface of the surfboard 400, the middle section of the connector interface 424 extends outward while the sides of the connector interface 424 recede inward, thus forming a "w" shape.

For some embodiments, the extended portions of the connector interface 414 are designed to overlap with the recessed portions of the connector interface 424, and vice-versa. For example, the "w" shaped edge of the head connector interface 414 is contoured to interconnect with the "v" shaped edge of the tail segment 424. Similarly, the "v" shaped edge of the head segment 414 is contoured to interconnect with the "w" shaped edge of the tail segment 424.

In other embodiments, the connector interface 414 may include one or more connector rods 411 which connect to corresponding holes or indentations on the connector interface 424 to provide additional structural support along the edges of the surfboard 400. For example, the connector rods 411 may help direct forces from the edges of the surfboard 400 to the center for improved handling or response. Alternatively, or in addition, the connector rods 411 may direct forces to one or more stringer elements that run through the body of the surfboard 400 for improved structural integrity (e.g., as described above with respect to FIGS. 1E-1J).

The twisted connector interface design of FIGS. 4A-4C has many advantages. For example, the contoured edges (e.g., the "v" and "w" shaped edges) help align the tail segment 420 with the head segment 410 during assembly of the surfboard 400. In addition, the interleaved manner in which the head segment 410 and the tail segment 420 overlap one another helps to distribute rider weight (and/or other forces on the surfboard) more uniformly across the entire width of the intersection of the two segments. Thus, the segmented surfboard 400, when fully assembled, may be configured to more closely mimic the response and feel of a typical surfboard having a unibody construction.

For some embodiments, connector interfaces 414 and 424 may be formed from a relatively stiff material (e.g., fiberglass, carbon fiber, wood, etc.) that is similar, if not identical to the material used to construct the body of the surfboard 400 (e.g., as discussed above in reference to FIGS. 1A and 1B). Alternatively, the connector interfaces 414 and 424 may be constructed, at least partially, of a different material than the rest of the surfboard 400.

For example, the connector interface 414 and 424 may be constructed of an elastomeric material, in order to enable the tail segment 420 to flex or bend relative to the head segment 410. The elastomeric material may also dampen or absorb stresses applied to the connector interfaces 414 and 424, and thus improve the overall strength and durability of the surfboard 400. As described above, the stiffness of the elastomeric material may be selected according to a rider's height, weight, skill lever, or preference.

The total overlapping area between the head segment 410 and the tail segment 420 may also vary, depending on the desired level of flex between the two segments. More specifically, the precise shape and/or location (e.g., along the length of the surfboard 400) of the twisted interface may be arbitrary as long as there is enough overlap between the connector interfaces 414 and 424 to prevent the head segment 410 from detaching from the tail segment 420 under the stress of the rider's weight and/or various surf conditions.

The head segment 410 includes a latching mechanism 416 for attaching the head segment 410 to the tail segment 420. The tail segment 420 includes a corresponding latching mechanism 426 which connects to the latching mechanism 416 on the head segment 410. The latching mechanisms 416 and 426 may be disposed in the center of the connector interfaces 414 and 424, respectively, to provide additional support at the center of the interface between the head segment 410 and the tail segment 420. Furthermore, the latching mechanisms 416 and 426 may help pull forces on the board toward the center of the board or toward one or more stringer elements (e.g., as described above with respect to FIGS. 1E-1J).

It should be noted that the segmented surfboard 400 may include additional features and/or advantages that are similar, if not identical, to those described above, in reference to the segmented surfboard 100 of FIGS. 1A and 1B (e.g., such as channels for guiding water flow, tail fins, stringers, etc.).

Figure 5A:
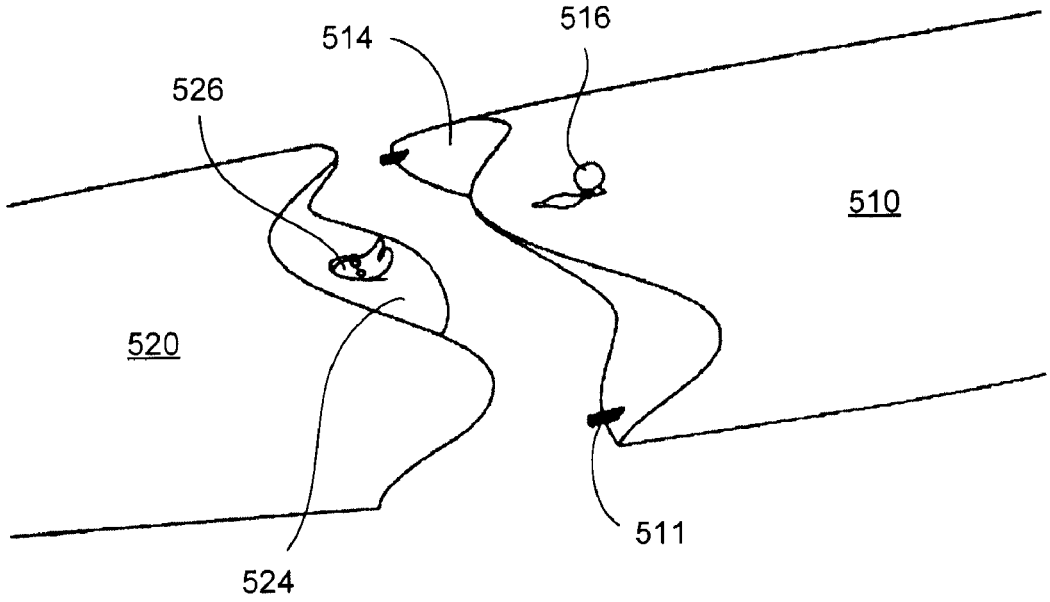
FIGS. 5A and 5B are detailed views of an interleaved connector interface, according to an embodiment.
Figure 5B:
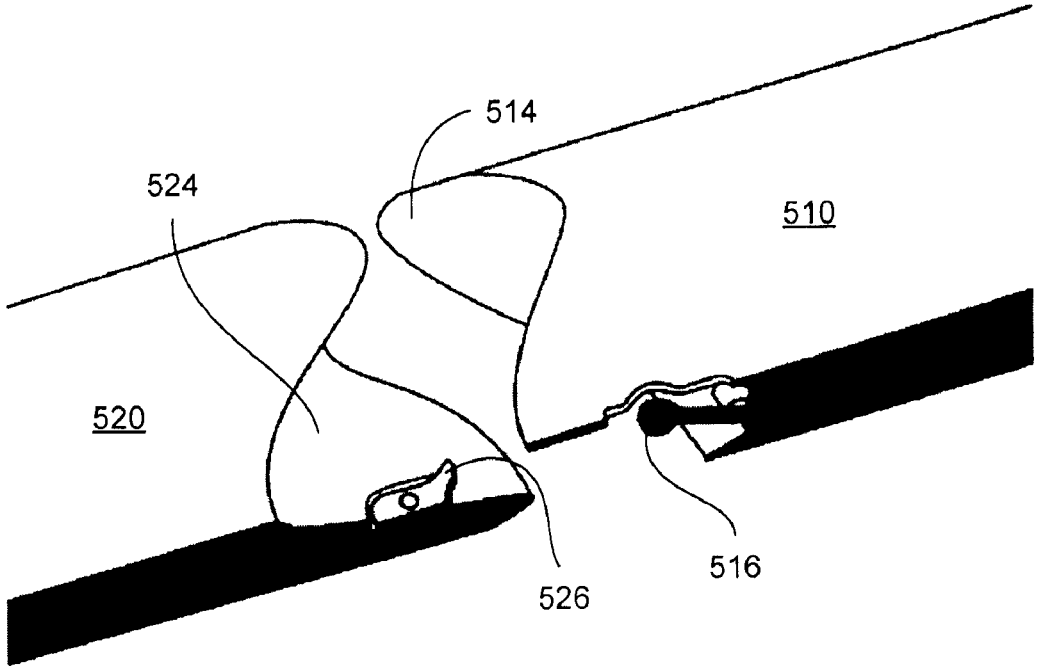

FIGS. 5A and 5B illustrate detailed views of an interleaved connector interface, according to an embodiment. Specifically, FIG. 5A shows an isometric view, and FIG. 5B shows a cross-sectional view of a head segment 510 and a corresponding tail segment 520. The head segment 510 includes a twisted connector interface 514 with a hook feature 516 disposed thereon. The tail segment 520 includes a twisted connector interface 524 with a corresponding latch fixture 526. As discussed above, the connector interface 514 includes both male and female connector features on the top and bottom surface of the head segment 510. The connector interface 524 includes complementary male and female connector features on the top and bottom surface of the tail segment 520, which connect to the connector interface 514.

The male-female interconnection of the connector interfaces 524 and 514 allows the surfboard to have a substantially seamless surface. For example, the outer surface of the connector interface 514 may be flush with (or at least substantially similar to) the outer shell of the head segment 510. Similarly, the outer surface of the connector interface 524 may be flush with the outer shell of the tail segment 520. This allows the inner portion of the connector interfaces 514 and 524 to be substantially hidden from view when the tail segment 520 is attached to the head segment 510.

For some embodiments, the tips (or outer edges) of the connector interfaces 514 and 524 are relatively thin to allow a greater degree of flex between the head segment 510 and tail segment 520. For example, each of the connector interfaces 514 and 524 may gradually "thin out" at distances further away from the rest of the head segment 510 and tail segment 520, respectively. Thus, the thickness (or thinness) of the connector interfaces 514 and 524 may also affect the handling and maneuverability of the surfboard.

The tail segment 520 may be secured to the head segment 510 by lowering the hook feature 516 into a locked position with the latch fixture 526 (e.g., as described above in reference to FIGS. 2A-3B). For example, the hook feature 516 may be pivotally attached to the connector interface 514 via a hinge. The top surface of the connector interface 514 includes a hole or slot through which the hook feature 516 may pivot into locked and unlocked positions. The hook feature 516 may be in the shape of a ball, such that when hooked onto the latch fixture 526, the tail segment 520 may be allowed to flex relative to the head segment 510. Thus, the hook feature 516 may continuously pull on the latch fixture 526 regardless of how the tail segment 520 bends or flexes.

For some embodiments, the connector interface 514 may include one or more connector rods 511 which connect to corresponding holes or indentations on the connector interface 524. The connector rods 511 may provide additional structural support along the edges of the surfboard, while further directing forces from the edges of the board to the center and distributing stress throughout the surfboard to control the flex of the board. Furthermore, the connector rods 511 can be used to connect or distribute forces to one or more stringer elements disposed across the head segment 510 and/or the tail segment 520 (e.g., as described above with respect to FIGS. 1E-1J).

Figure 6A:
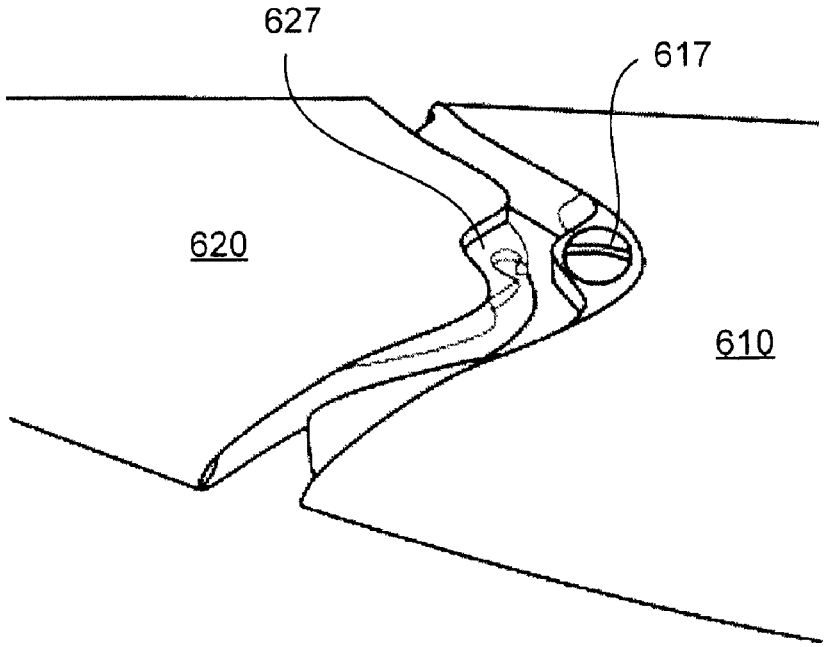
FIGS. 6A and 6B illustrate a latching mechanism for attaching the segments of a segmented surfboard according to another embodiment.
Figure 6B:
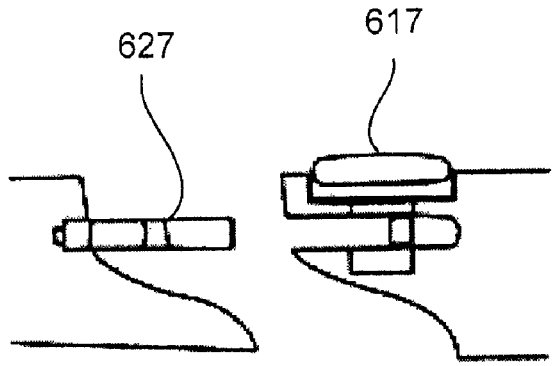

FIGS. 6A and 6B illustrate a latching mechanism 600 for attaching the segments of a segmented surfboard, according to another embodiment. Specifically, FIG. 6A shows an isometric view, and FIG. 6B shows a cross-sectional view of the latching mechanism. The embodiments of FIGS. 6A and 6B show a rotatable latching feature 617 disposed on a surfboard segment 610, and a corresponding latch fixture 627 disposed on a complementary surfboard segment 620. For purposes of discussion, it is assumed that the surfboard segment 610 corresponds to a head segment of a segmented surfboard, whereas the surfboard segment 620 corresponds to the tail segment.

According to an embodiment, the latching feature 617 may be rotated (e.g., twisted or turned) to either engage or disengage with the latch fixture 627. For example, the latching feature 617 may be "spring-loaded" and thus configured to automatically lock onto the latch fixture 627 when the tail segment 620 is connected to the head segment 610. A user may then twist the latch feature 617 to unlock the latching feature 617 from the corresponding latch fixture 627 when disassembling the segmented surfboard. Alternatively, the latching feature 617 may be turned manually (e.g., using a coin or a screwdriver) to both lock and unlock the latching feature 617 from the latch fixture 627.

The latching mechanism described in FIGS. 6A and 6B provides a simple and secure way to attach the tail segment 620 to the head segment 610. Because no moving parts pivot up or out from the surface of the board, the top of the latching feature 617 may be disposed in a manner that is flush with the outer shell of the head segment 610. In addition, a tighter seal may be formed between the head segment 610 and the tail segment 602 as there is no hole or opening on the surface of the board when the two segments are connected. In alternative embodiments, two or more sets of latching mechanisms 600 may be used to connect the surfboard segments 610 and 620 together (e.g., one along each rail or outer edge).

Figure 7:
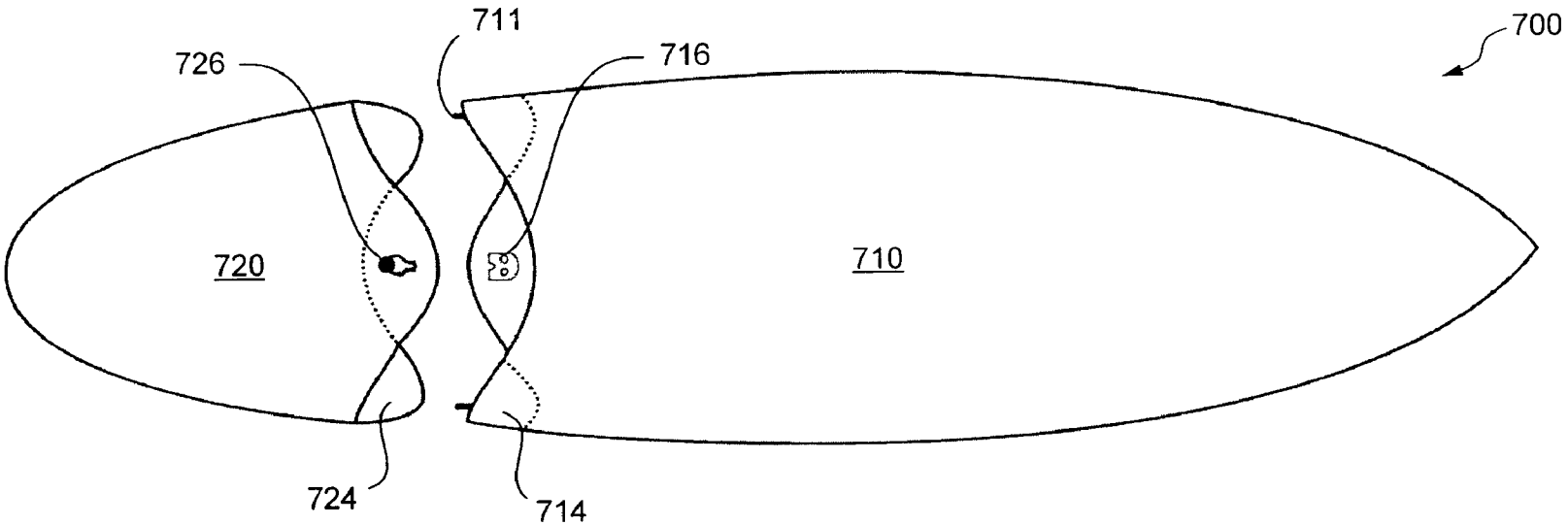
FIG. 7 illustrates an alternative embodiment of a segmented surfboard.

FIG. 7 illustrates an alternative embodiment of a segmented surfboard 700. The segmented surfboard 700 may be functionally similar to any of the embodiments described above, with respect to FIGS. 1-5B, with the exception that the hook feature 726 is now located on the tail segment 720 while the latch fixture 716 is located on the head segment 710. In operation, the hook feature 726 is pivotable while latched to the latch fixture 716, thus allowing the tail segment 720 to bend and flex in relation to the head segment 710. In alternative embodiments, the hook feature 726 and latch fixture 716 may be substituted for a rotatable latching feature 617 and latch fixture 627, respectively, as described above with respect to FIGS. 6A and 6B.

In the embodiment shown, the connector interfaces 714 and 724 form a twisted or interleaved shape (e.g., as discussed above with respect to FIGS. 4A-4C). Alternatively, the connector interfaces may be cut in any of the non-linear shapes described above (e.g., with respect to FIGS. 1A-1L and FIG. 10), to help guide the head segment 710 into place with the tail segment 720 and/or lock the two segments together.

In addition, one or more connector rods 711 can be used to provide additional structural support along the rails of the surfboard 700 by directing forces from the edges of the surfboard 700 toward the center and/or one or more stringer elements (e.g., as described above with respect to FIGS. 1E-1J).

Figure 8:
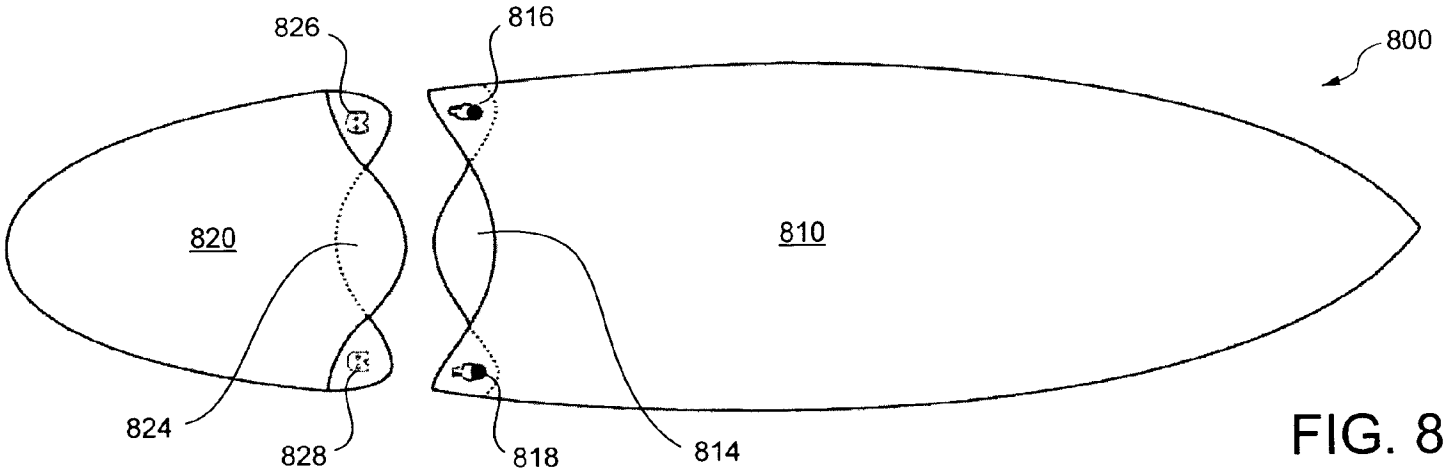
FIG. 8 illustrates a segmented surfboard embodiment having multiple sets of latching mechanisms.

FIG. 8 illustrates a segmented surfboard embodiment having multiple sets of latching mechanisms. Specifically, in this embodiment, the head segment 810 includes two hook features 816 and 818 that latch on to corresponding latch fixtures 826 and 828, respectively, on the tail segment 820. The two sets of latching mechanisms provide additional structural support along the rails of the surfboard 800 and may further help to direct forces toward the center and/or one or more stringer elements disposed along the length of the surfboard. Both hook features 816 and 818 may be pivotally coupled to the latch fixtures 826 and 828, respectively, thus allowing the tail segment 820 to bend and flex in relation to the head segment 810.

In alternative embodiments, one or more of the hook features 816 and/or 818 may be substituted for a rotatable latching fixture 617, the latch fixture 826 and/or 828 may be substituted for a latch fixture 627. Although shown in the twisted configuration, the connector interfaces 814 and 824 may alternatively be cut in any of the non-linear shapes described above (e.g., with respect to FIGS. 1A-1L and FIG. 10), to help guide the head segment 810 into place with the tail segment 820 and/or lock the two segments together.

Figure 9:
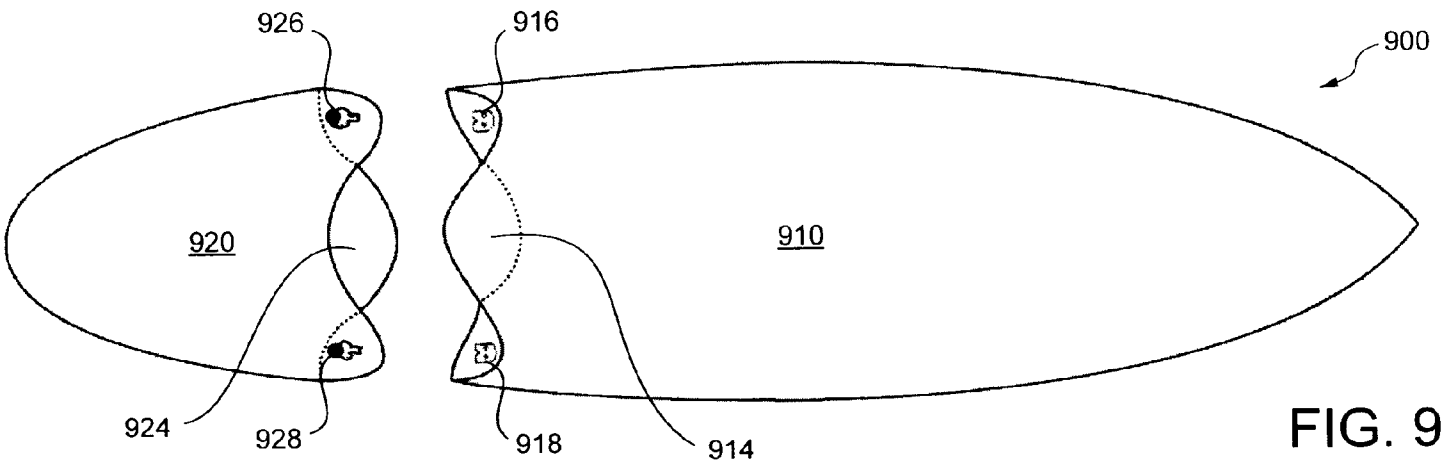
FIG. 9 illustrates an alternative embodiment of a segmented surfboard embodiment having multiple sets of latching mechanisms.

FIG. 9 illustrates an alternative embodiment of a segmented surfboard embodiment having multiple sets of latching mechanisms. The segmented surfboard 900 may be functionally similar to the segmented surfboard 800, of FIG. 8, with the exception that the hook features 926 and 928 now reside on the tail segment 920 while the latch fixtures 916 and 918 are both located on the head segment 910. In alternative embodiments, one or more of the hook features 926 and/or 928 may be substituted for a rotatable latching feature 617, while the latch fixture 916 and/or 928 may be substituted for a corresponding latch fixture 627.

Although shown in the twisted configuration, the connector interfaces 914 and 924 may alternatively be cut in any of the non-linear shapes described above (e.g., with respect to FIGS. 1A-1L and FIG. 10), to help guide the head segment 910 into place with the tail segment 920 and/or lock the two segments together.

Figure 11A:
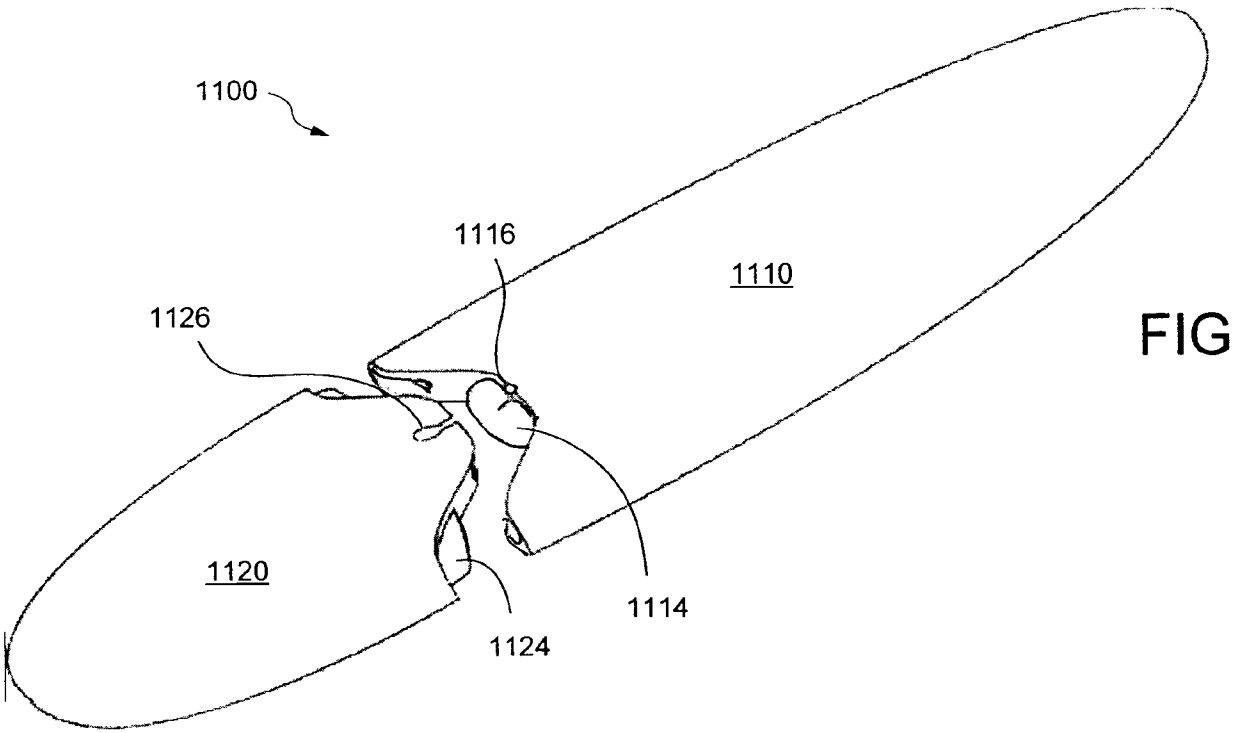
FIGS. 11A and 11B illustrate an embodiment of a segmented longboard.
Figure 11B:
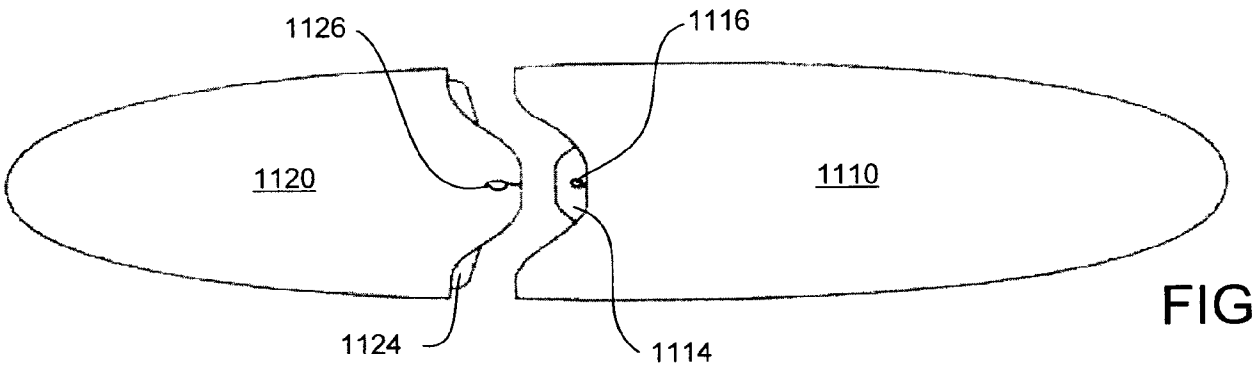

FIGS. 11A and 11B illustrate an embodiment of a segmented longboard 1100. The segmented longboard 1100 includes a head segment 1110 having a hook feature 1116 which pivotably couples to a corresponding latch fixture 1126 on the tail segment 1120. For some embodiments, the head segment 1110 is longer than the tail segment 1120, and forms the main body of the longboard 1100. As with the segmented surfboard embodiments described above, the shape of the nose of the head segment 1110 may be more rounded or more pointed, for example, to improve the maneuverability or stability of the longboard 1100.

The head segment 1110 may be composed of various types of material including, for example, a composite plastic skin laminated with fiberglass, wood, carbon fiber, or similar material. Furthermore, the head segment 1110 may be either hollow or filled with a buoyant material (e.g., wood or foam). It should be noted that the material composition of the head segment 1110 may affect the weight and/or durability of the longboard 1100. For some embodiments, the head segment 1110 may include one or more stringer elements (e.g., as described above with respect to FIGS. 1E-1J).

As with the nose of the head segment 1110, the rear tip of the tail segment 1120 may also have a unique shape or contour to affect the flow of water beneath the tail of the longboard 1100 (e.g., pin tail, squash tail, swallow tail, etc.). The tail segment 1120 may be composed of various types of material (e.g., similar to those described above with respect to the head segment 1110). Alternatively, the tail segment 1120 may be hollow or filled with a buoyant material. For some embodiments, the tail segment 1120 may also include one or more stringer elements (e.g., as described above with respect to FIGS. 1E-1J).

A connector interface 1124 of the tail segment 1120 connects to a corresponding connector interface 1114 of the head segment 1110. The edges of the connector interface 1114 are contoured to the edges of the connector interface 1124 to form a seal at the intersection of the head segment 1110 and the tail segment 1120. Additionally, the contoured edges may serve to align the rails of the board for a proper fit and/or lock the two segments in place. The non-linear edges of the connector interfaces 1114 and 1124 may also help to control the manner in which the tail segment 1120 is able to flex (or "vibrate") relative to the head segment 1110.

Due to the relatively large size and weight of the longboard 1100, the connector interface 1114 on the head segment 1110 includes a "tongue" feature which inserts into a corresponding groove of the connector interface 1124 on the tail segment 1120. Because of its length, the longboard 1100 is much more prone to bending when even the slightest external forces are applied. Thus, the overlapping tongue-and-groove interface forms a much stronger connection between the two segments of the longboard 1100.

Although not shown in FIG. 11, the segmented longboard 1100 may further include one or more additional features such as those described above with respect to the segmented surfboard 100 (e.g., tail fins, curved or flat surfaces, etc.). Furthermore, alternative ways of "cutting" the longboard in a non-linear manner (e.g., to form the connector interfaces 1114 and 1124) are discussed above with respect to FIG. 10.

Figure 12A:
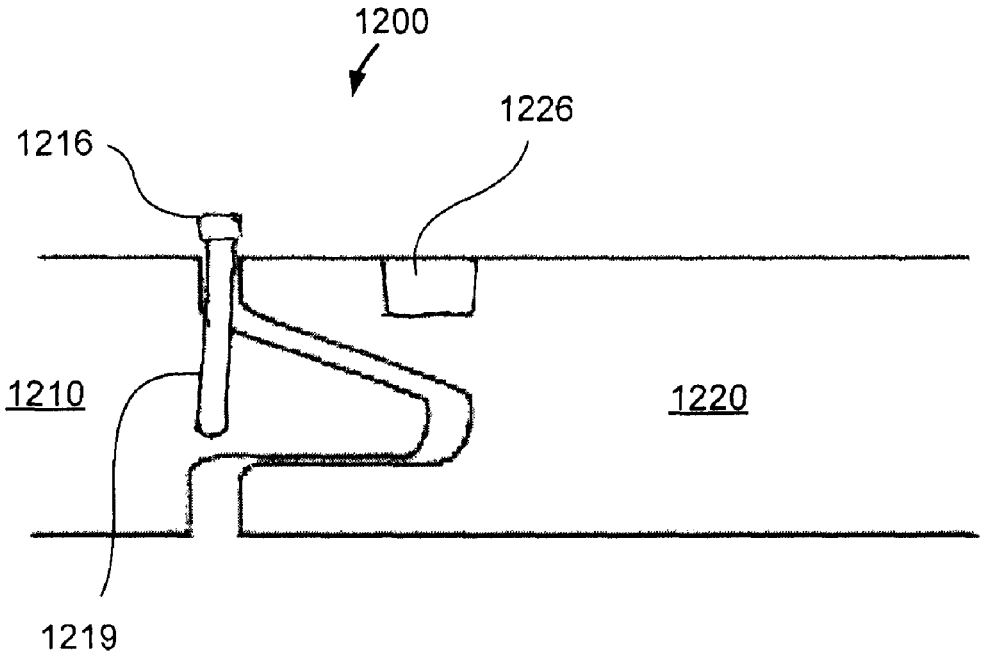
FIGS. 12A and 12B illustrate cross-sectional views of a latching mechanism used on the segmented longboard.
Figure 12B:
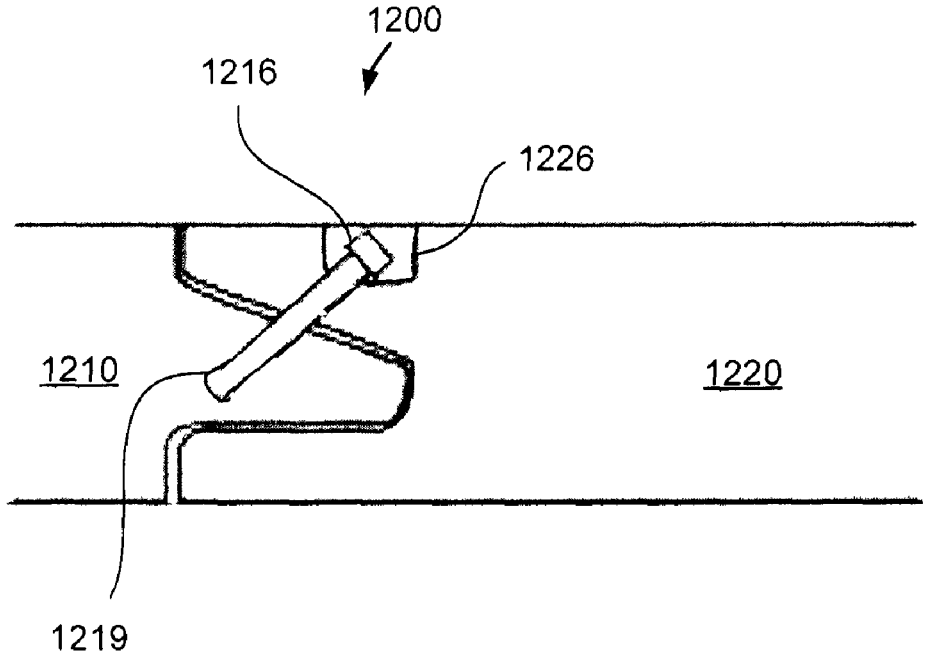

FIGS. 12A and 12B illustrate cross-sectional views of a latching mechanism 1200 used on the segmented longboard 1100. The embodiments of FIGS. 12A and 12B show an interface lever assembly 1219, having a hook feature 1216, disposed on a longboard segment 1210. A corresponding latch fixture 1226 is disposed on a complementary longboard segment 1220. For purposes of discussion, it is assumed that the longboard segment 1210 corresponds to a head segment of a segmented longboard, whereas longboard segment 1220 corresponds to the tail segment.

FIG. 12A shows the latching mechanism 1200 in an open or unlatched state. The interface lever 1219 is in an "up" position, causing the hook feature 1216 to be unhooked from the latch fixture 1226. As with the interface lever 319 of FIGS. 3A-3B, the interface lever 1219 connects to the head segment 1210 via a vertical hinge, and thus is able to pivot in only two directions (i.e., up or down). The pivotable interface lever 1219 further allows the hook feature 1216 to remain locked to the latch fixture 1226 even as the geometry of the longboard changes (e.g., while the tail segment 1220 bends in relation to the head segment 1210).

The latch fixture 1226 is located within a recessed cavity of the tail segment 1220 (or a connector interface disposed thereon). For some embodiments, the latch fixture 1226 is integrally formed with the connector interface of the tail segment 1220. The latch fixture 1226 includes an opening or slit leading up to the recessed cavity (e.g., as shown in FIGS. 11A and 11B) which allows the interface lever 1219 to be lowered into as the hook feature 1216 is locked into place.

FIG. 12B shows the latching mechanism 1200 in a closed or locked state. The interface lever 1219 is in a "down" position, and rests within the slit or groove in the latch fixture 1226. The hook feature 1216 is substantially wide enough to prevent it from slipping through the slit in the latch fixture 1226. The hook feature 1216 hooks onto the edges of the latch fixture 1226 and pulls the tail segment 1220 in towards the head segment 1210 (or vice-versa). According to an embodiment, the hook feature 1216 is a ball, or similarly shaped object, which may rotate or pivot while in locked position with the latch fixture 1226.

The shape of the hook feature 1216, in conjunction with the hinged attachment of the interface lever 1219 to the head segment 1210, allows the tail segment 1220 to flex or bend while remaining securely attached to the head segment 1210. In addition, the vertically-hinged interface lever 1219 allows the tail segment 1220 to flex in a vertical direction, while also preventing the tail segment 1220 from slipping or sliding in a horizontal direction. The latching mechanism 1200 is disposed in the middle of the connector interface of the head segment 1210 and the tail segment 1220, and further helps to distribute forces along the middle of the longboard.

Additional features and advantages of the latching mechanism 1200 may be similar, if not identical, to those of the latching mechanism 300 discussed above with respect to FIGS. 3A-3C.

Figure 13:
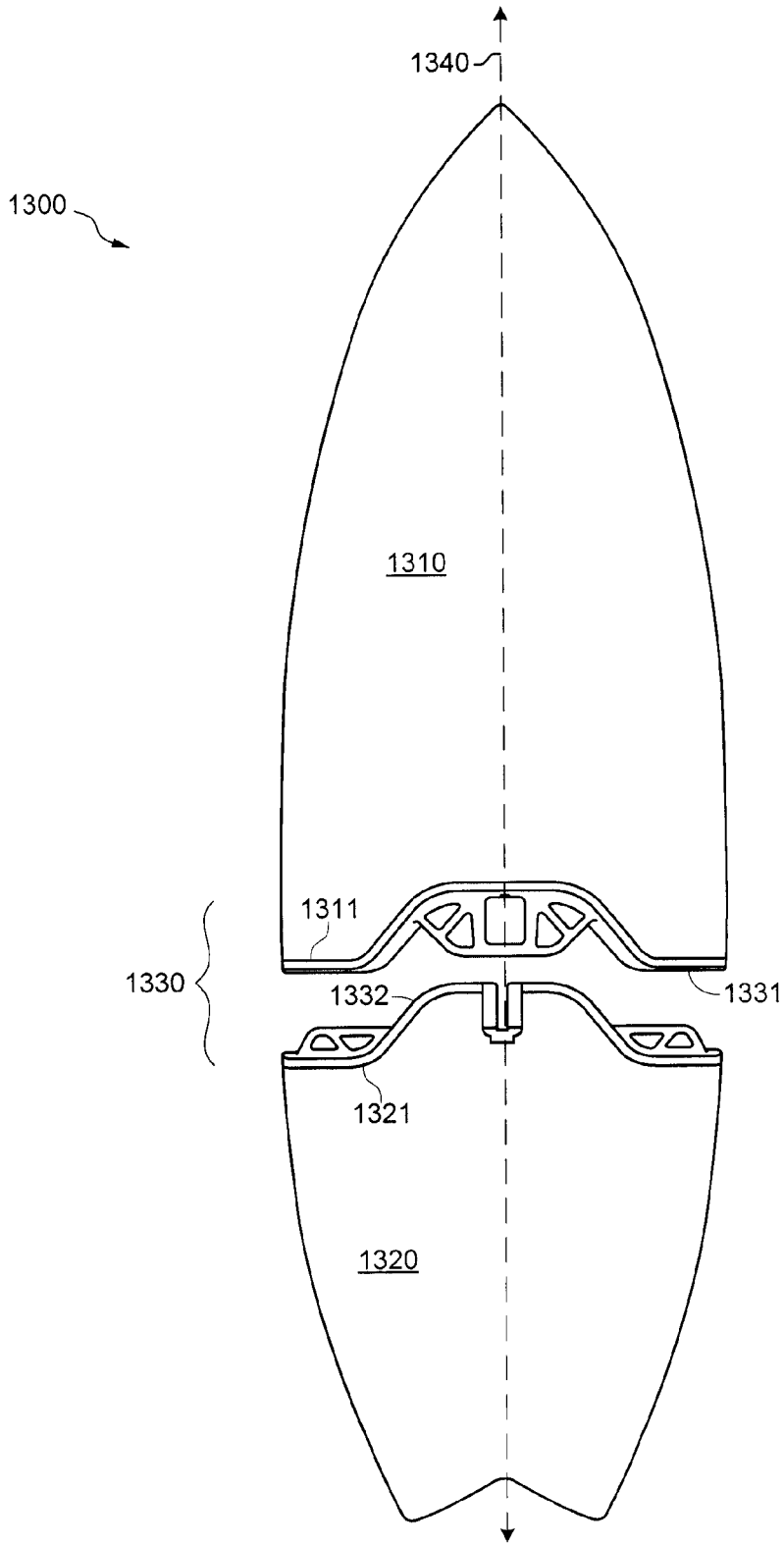
FIG. 13 is a top plan view of detached head and tail segments of a segmented waterboard including an interface system in accordance with some embodiments.

FIG. 13 illustrates a segmented surfboard system 1300 in accordance with other embodiments. Surfboard system 1300 includes a head segment 1310, a tail segment 1320, and an interface system 1330 for removably attaching the head segment 1310 and tail segment 1320 together to form the integrated surfboard 1300. The interface system 1330 includes a head interface connecter 1331 and a tail interface connecter 1332 that can be cinched together within a tension having moment substantially collinear with a central axis 1340 of the surfboard 1300.

Figure 14:
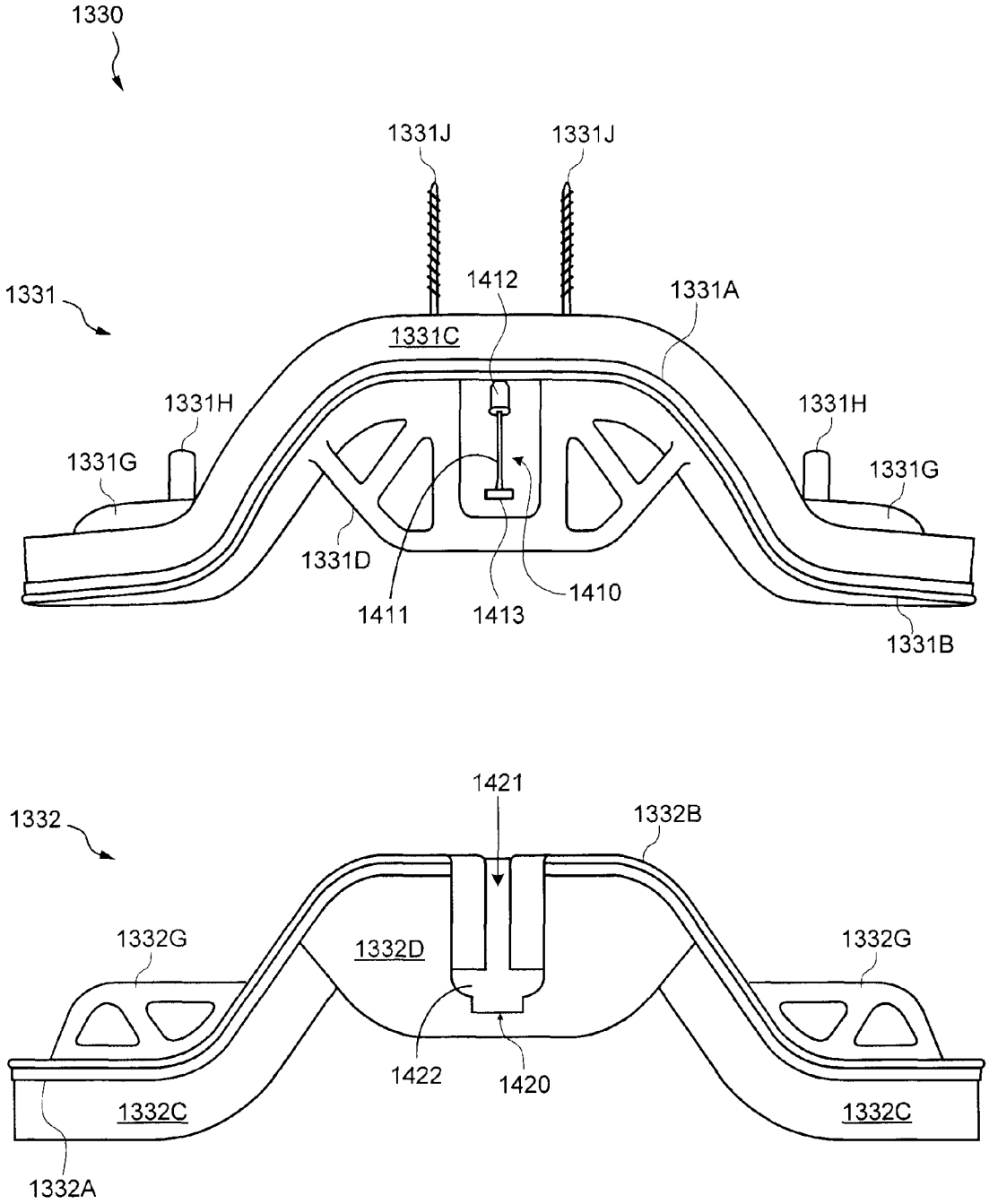
FIG. 14 is a top plan view showing the interface system of FIG. 13 in more detail.
Figure 15:
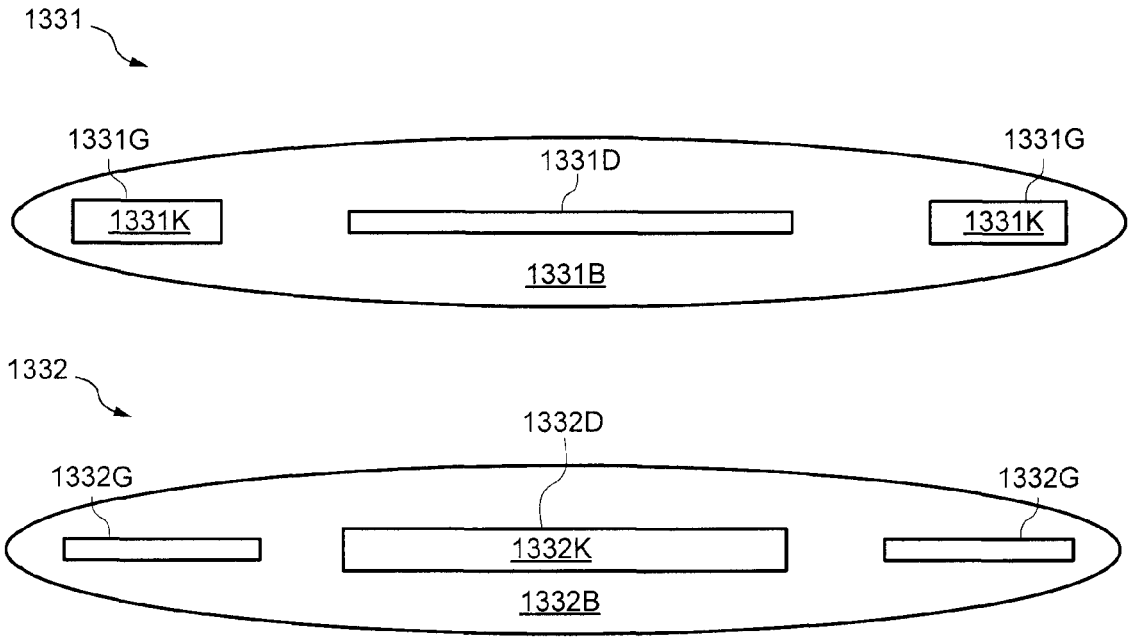
FIG. 15 is a cross-sectional view of the head and tail interface connecters of FIG. 14.
Figure 16:
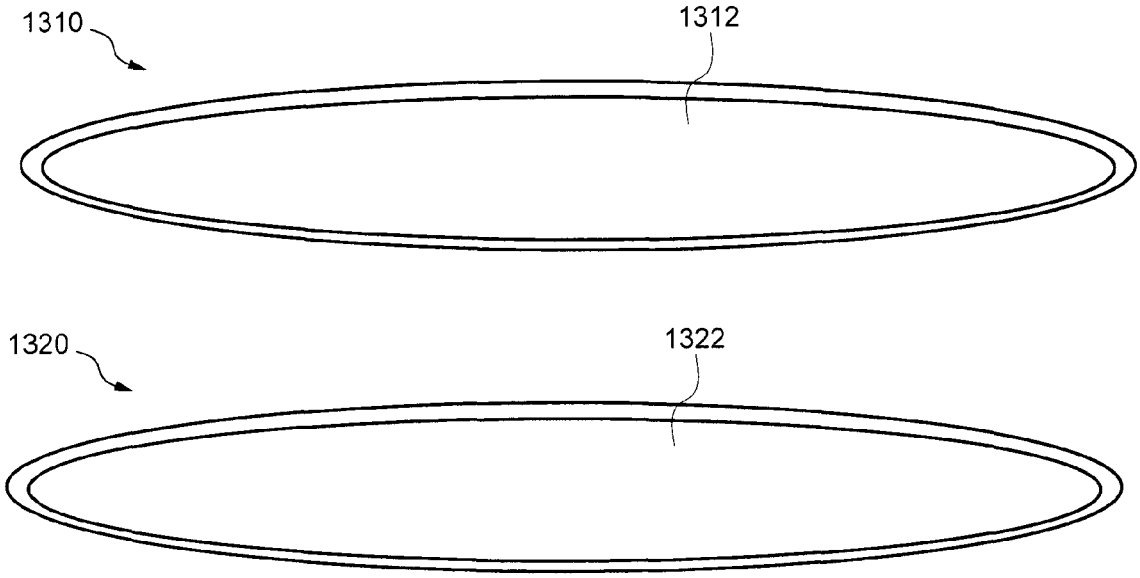
FIG. 16 is a cross-sectional view of the head and tail segments of the waterboard FIG. 14.
Figure 17:
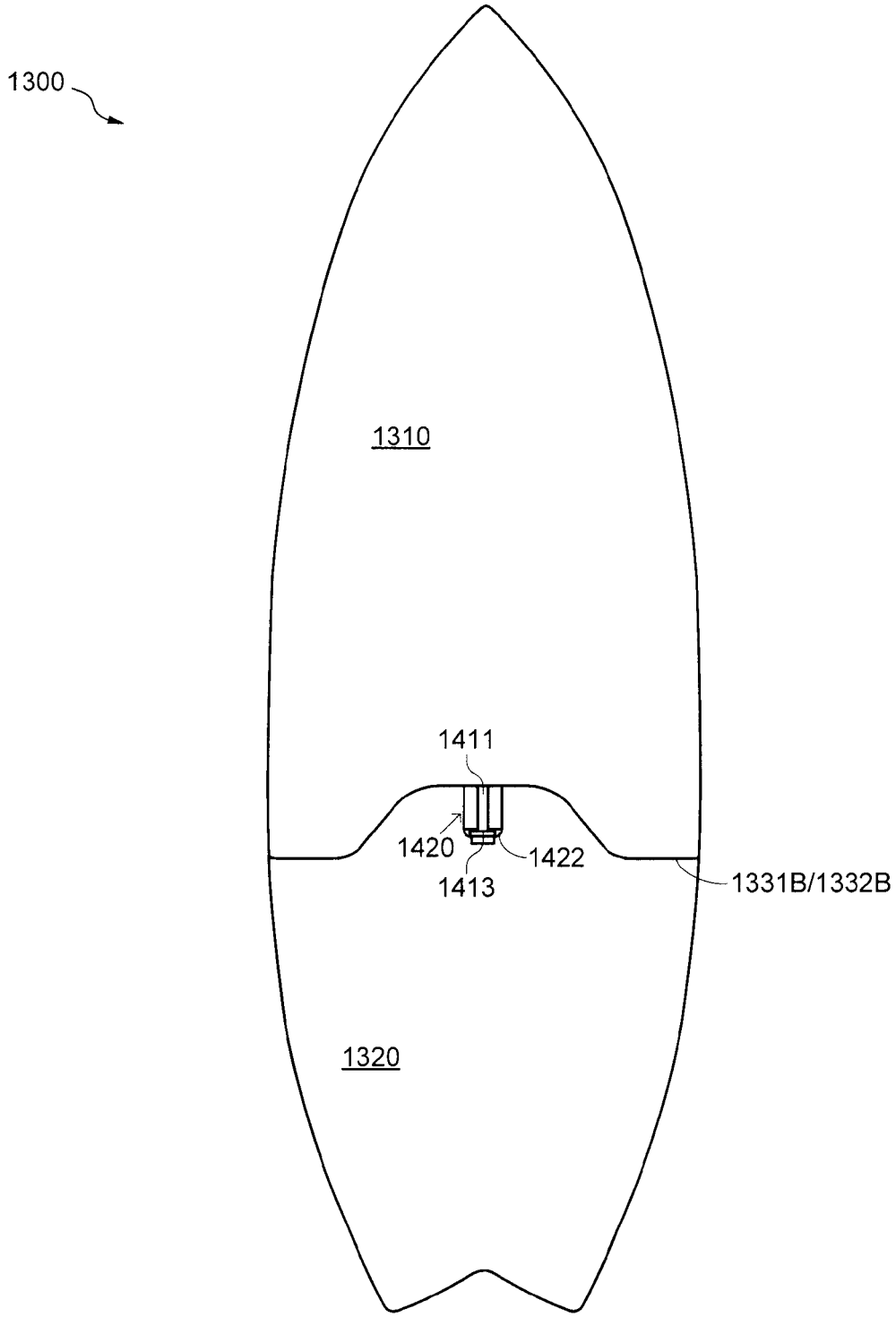
FIG. 17 is a top plan view of the head and tail segments of the segmented waterboard of FIG. 13 attached together to form an integrated waterboard.

Referring also to FIGS. 14-16, the head segment 1310 includes a concave rear edge 1311 that mates with and attaches to a corresponding convex surface 1331A of the head interface connecter 1331, and the tail segment 1320 includes a concave front edge 1321 that mates with and attaches to a corresponding concave surface 1332A of the tail interface connecter 1332. The head interface connecter 1331 includes a main portion 1331C that inserts into a corresponding slot 1312 formed in head segment 1310 such that the lip portion 1331A of head interface connecter 1331 is flush with the outer surface of head segment 1310 when connected together, as depicted in FIG. 13. Screws 1331J provided on head interface connecter 1331 can be used to firmly secure head interface connecter 1331 to head segment 1310. Further, for some embodiments, the head interface connecter 1331 includes rods 1331H that can be received by corresponding bores (not shown for simplicity) formed in head segment 1310, thereby providing additional alignment between head interface connecter 1331 and head segment 1310. For other embodiments, screws 1331J and/or rods 1331H can be omitted, and the head interface connecter 1331 can be attached to head segment 1320 using a suitable adhesive or bonding material.

The head interface connecter 1331 also includes a blade element 1331D that extends from the main portion 1331C along the direction of the board's central axis 1340, and includes a cavities 1331K formed within corresponding housings 1331G positioned on each side (e.g., close to the outer rails of the waterboard) of the head interface connecter 1331, as depicted in FIGS. 14 and 15.

A lever assembly 1410 including a bolt 1411 having a joint 1412 formed at a first end thereof is pivotally connected to the surface 1331B of the head interface connecter 1331 via a pin (not shown for simplicity) embedded in the main portion 1331C. A lug 1413 is attached to a second end of the bolt 1411 that allows the bolt to removably attach the head interface connecter 1331 and the tail interface connecter 1332 together, as explained in more detail below. For some embodiments, the lever assembly 1410 is constructed of metal. For other embodiments, lever assembly 1410 may be constructed of a flexible material (e.g., plastic, polymer, fabric) that is able to bend in relation to forces applied to and/or between the tail and head segments.

The tail interface connecter 1332 includes a main portion 1332C that inserts into a corresponding slot 1322 formed in tail segment 1320 such that the lip portion 1332A of tail interface connecter 1332 is flush with the outer surface of tail segment 1320 when connected together. For some embodiments, the tail interface connecter 1332 can be attached to tail segment 1320 using a suitable adhesive or bonding material. For other embodiments, screws (not shown for simplicity) similar to screws 1331J of head interface connecter 1331 can be used to firmly secure tail interface connecter 1332 to tail segment 1320. In addition, tail interface connecter 1332 can include rods similar to rods 1331H to provide additional alignment between tail interface connecter 1332 and tail segment 1320.

Tail interface connecter 1332 includes a central housing portion 1332D that includes a slot 1332K adapted to receive the blade element 1331D of head interface connecter 1331, and includes tab elements 1332G that are adapted to be inserted into corresponding cavities 1331K of head interface connecter 1331. Thus, when head interface connecter 1331 and tail interface connecter 1332 are connected together, the male portion 1331D of head interface connecter 1331 mates with female portion 1332K of tail interface connecter 1332, and the male portions 1332G of tail interface connecter 1332 mate with corresponding female portions 1331K of head interface connecter 1331, thereby ensuring a secure connection between the head and tail interface connecters.

For some embodiments, tab elements 1332G are oriented in a direction parallel with the central axis 1340 of the waterboard 1300. For other embodiments, tab elements 1332G are oriented at a slight angle (e.g., between 10 and 20 degrees) to facilitate self alignment when connecting the head segment 1310 to the tail segment 1320. For such other embodiments, receiving cavities 1331K are oriented at a similar angle to ensure proper alignment.

The tail interface connecter 1332 also includes a T-shaped notch 1420 formed on a top surface of central housing member 1332D. The T-shaped notch 1420 is adapted to receive the lever assembly 1410 of the head interface connecter 1331. More specifically, to removably attach the head segment 1310 to the tail segment 1320, the head segment 1310 and tail segment 1320 are joined together so that the blade element 1331D of head interface connecter 1331 is positioned within slot 1332K of tail interface connecter 1332 and the tab elements 1332G of tail interface connecter 1332 are positioned within corresponding slots 1331K of the head interface connecter 1331. In this manner, the concave surface 1331B of head interface connecter 1331 mates with the convex surface 1332B of tail interface connecter 1332 to connect the head segment 1310 and tail segment 1320 together. Then, the bolt 1411 attached to head interface connecter 1331 is pivoted from its open position (e.g., the vertically-oriented direction perpendicular to central axis 1340) to its closed position (e.g., the horizontally-oriented direction collinear to central axis 1340) such that bolt 1411 rests in the elongated portion 1421 portion of notch 1420 and the bolt lug 1413 rests within the wider portion 1422 of notch 1420, as shown in FIG. 16.

For some embodiments, a flexible pad or cover (not shown for simplicity) can be provided over notch 1420 to hide notch 1420 and lever assembly 1410 from view. For one embodiment, the flexible pad includes a hole or opening through which the lever assembly 1410 may be manually released or unhooked from the notch 1420.

Note that the lever assembly 1410 is connected to head interface connecter 1331 via a pivoting hinge, and is thus able to pivot in only two directions (i.e., up or down). This provides a simple locking mechanism because it allows the lever assembly 1410 to be easily lowered into a locked position within notch 1420, and easily raised from notch 1420 into an unlocked position. The pivotable lever assembly 1410 further allows the bolt 1411 to remain locked within the notch 1420 even when the geometry of the surfboard changes (e.g., while the tail segment 1320 bends in relation to the head segment 1310).

When the lever assembly 1410 is in the locked position within the corresponding notch 1420, the lug 1413 hooks onto the edges of the wide portion 1422 of notch 1420 and pulls the tail segment 1320 towards the head segment 1310. More specifically, because the lever assembly 1410 is substantially horizontal (i.e., collinear with the central axis 1340 of the board 1300) when in the locked position, the lug 1413 of lever assembly 1410 pulls the tail segment 1320 in towards the head segment 1310 in a cinching action having a tension moment that is substantially collinear with the central axis 1340 of the board 1300, thereby advantageously aligning the force that pulls the head segment 1310 and tail segment 1320 together with the direction of the board 1300 when in the water.

The shape and pivoting nature of the lever assembly 1410 allows the tail segment 1320 to flex while remaining securely attached to the head segment 1310. For example, regardless of how much the lever assembly 1410 pivots relative to the central axis 1340, the bolt lug 1413 will continue pulling the notch (i.e., the tail segment 1320) toward the head segment 1310. In addition, the vertically-hinged lever assembly 1410 allows the tail segment 1320 to flex in a vertical direction, while also preventing the tail segment 1320 from slipping or sliding in a horizontal direction. For the exemplary embodiment shown in FIGS. 13-16, the lever assembly 1410 and notch 1420 are disposed in the middle of the interface system 1330 to distribute forces along the middle of the surfboard.

Referring to FIGS. 13 and 14, when the head segment 1310 is properly attached to the tail segment 1320 using interface system 1330, the blade element 1331D of head interface connecter 1331 fits entirely within the slot 1332K formed in the tail interface connecter 1332, and the tab elements 1332G of the tail interface connecter 1332 fit entirely within corresponding slots 1331K formed in the head interface connecter 1331. Thus, no portion of head interface connecter 1331 overlaps the tail segment 1320, and no portion of tail interface connecter 1332 overlaps the head segment 1310. As a result, the lateral forces exerted upon the board 1300 during use (e.g., while surfing) are absorbed by the interface system 1330, which is constructed of injection molded plastic and is therefore significantly stronger than the foam portions of the head and tail segments 1310 and 1320.

For other embodiments, the various components of interface system 1330 can be constructed of other suitable elastic molded materials (e.g., self skinning foam, woven fiberglass, carbon fiber).

For some embodiments, the amount of pull exerted by the lever assembly 1410 on the notch 1420 is adjustable to allow the user to further customize the amount of flex in the tail segment 1320. For example, once the lever assembly 1410 is placed in the locked position within notch 1420, the bolt lug 1413 may be tightened (e.g., for embodiments in which lug 1413 is screwed onto bolt 1411) by turning or twisting the lug 1413 with a finger or a wrench. Thus, the tighter the connection between the lever assembly 1410 and notch 1420, the less the tail segment 1320 is allowed to bend or flex relative to the head segment (and vice-versa).

Referring again to FIG. 13, a protective coating of suitable material (e.g., fiberglass) is used to encapsulate head interface connecter 1331 and head segment 1310 together to form an integrated head portion such that only the surface 1331B and blade element 1331D of head interface connecter 1331 are visible. Similarly, a protective coating of suitable material (e.g., fiberglass) is used to encapsulate tail interface connecter 1332 and tail segment 1320 together to form an integrated tail portion such that only the surface 1332B and tab elements 1332G of tail interface connecter 1332 are visible. In this manner, when the head and tail segments 1310 and 1320 are connected together to form the integrated waterboard 1330, the interface system 1300 is not visible and does not interfere with the riders' feet or hands, as depicted in FIG. 16. This not only enhances the aesthetic features of the waterboard, but also reduces drag and thus maximizes performance.

Note that although the exemplary interface system 1330 described herein includes a T-shaped notch 1421 to receive the lever assembly 1410, other suitable attachment mechanisms described herein may be used for the segmented waterboard 1300. In addition, for other embodiments, an attachment mechanism (e.g., the T-shaped notch 1421 and the lever assembly 1410) can be located near each side or rail of the waterboard.

The interface system 1330 described above may provide a universally-applicable solution for removably attaching head and tail segments of a waterboard together. For example, segmented surfboards of varying sizes, shapes, and performance characteristics can be constructed by a variety of different manufacturers to have cavities of uniform dimensions (e.g., size, shape, depth) formed in the head and tail segments so that interface system 1330 described herein can be used to removably connect the head and tail segments together in the manner described herein. In this manner, the start-up cost of designing and configuring the tools necessary to constructed interface connecters 1331 and 1332 can be distributed across a large number of pieces, and the interface system 1330 of present embodiments can be made available to removably attach a wide variety of different head and tail segments constructed by any number of manufacturers.

While the invention has been described with reference to specific embodiments thereof, it will be evident that various modifications and changes may be made thereto without departing from the broader spirit and scope of the invention. For example, features or aspects of any of the embodiments may be applied, at least where practicable, in combination with any other of the embodiments or in place of counterpart features or aspects thereof. Accordingly, the specification and drawings are to be regarded in an illustrative rather than a restrictive sense.

What is claimed is:

1. A waterboard, comprising:

a head segment having a concave rear edge;

a tail segment having a convex front edge; and an interface system to removably connect the head and tail segments together, the interface system comprising:

a head interface connecter having a convex first surface mating with and attached to the concave rear edge of the head segment and having a first blade element extending from a middle portion of a second surface opposite the first surface; and a tail interface connecter having a concave first surface mating with and attached to the convex front edge of the tail segment and having a second surface mating with and removably attached to the second surface of the first interface connecter, wherein the tail interface connecter includes a slot to receive the blade element.

2. The waterboard of claim 1, wherein the blade element is contained within the interface system.

3. The waterboard of claim 1, wherein the first blade element does not extend into the tail segment when the head and tail segments are attached.

4. The waterboard of claim 1, wherein the head and tail interface connectors comprise injection molded plastic.

5. The waterboard of claim 1, further comprising:

a pair of tab elements extending outward from side portions of the second surface of the tail interface connecter; and a pair of cavities formed within side portions of the second surface of the head interface connecter, wherein each of the cavities is to receive a corresponding tab element.

6. The waterboard of claim 5, wherein the tab elements do not extend into the head segment when the head and tail segments are attached.

7. The waterboard of claim 1, further comprising:

a first protective coating encapsulating the head segment and the head interface connecter together, wherein only the second surface and blade element of the head interface connector are accessible through the first protective coating; and a second protective coating encapsulating the tail segment and the tail interface connecter together, wherein only the second surface and the tab elements of the tail interface connector are accessible through the second protective coating.

8. The waterboard of claim 7, wherein the first and second protective coatings comprise fiberglass.

9. The waterboard of claim 1, further comprising an attachment system for releasably cinching the head and tail interface connecters together along a central axis of the waterboard extending through the head and tail segments.

10. The waterboard of claim 9, wherein the attachment system comprises:

a lever assembly including a bolt having a first end pivotally attached to the second surface of the head interface connecter, and including a lug formed on a second end of the bolt; and a T-shaped notch, formed on a top surface of the tail interface connecter, to receive the lever assembly.

11. The waterboard of claim 10, wherein when the lever assembly is positioned within the T-shaped notch, the head and tail segments are cinched together by a tension having a moment substantially collinear with a central axis of the waterboard.

12. A waterboard, comprising:

a head segment including a head interface connecter having an outer concave edge, having a first blade element extending from a middle portion of the outer concave edge, and having cavities formed on side portions of the outer concave edge;

a tail segment including a tail interface connecter having an outer convex edge for mating with and removably attaching to the outer concave edge of the head segment, having a slot to receive the blade element, and having tab elements, extending from the outer convex edge, to be inserted into corresponding cavities formed in the head interface connecter.

13. The waterboard of claim 12, wherein the blade element does not extend beyond the tail interface connecter.

14. The waterboard of claim 12, wherein the tab elements do not extend beyond the head interface connecter.

15. The waterboard of claim 12, wherein the head and tail interface connectors comprise injection molded plastic.

16. The waterboard of claim 12, further comprising:

a first protective coating encapsulating the head segment and the head interface connecter together, wherein only the second surface and blade element of the head interface connector are accessible through the first protective coating; and a second protective coating encapsulating the tail segment and the tail interface connecter together, wherein only the second surface and the tab elements of the tail interface connector are accessible through the second protective coating.

17. The waterboard of claim 16, wherein the first and second protective coatings comprise fiberglass.

18. The waterboard of claim 12, further comprising an attachment system for releasably cinching the head and tail interface connecters together along a central axis of the waterboard.

19. The waterboard of claim 18, wherein the attachment system comprises:

a lever assembly including a bolt having a first end pivotally attached to the outer concave edge of the head interface connecter, and including a lug formed on a second end of the bolt; and a T-shaped notch formed on a top surface of the tail interface connecter, to receive the lever assembly.

20. The waterboard of claim 19, wherein when the lever assembly is positioned within the T-shaped notch, the head and tail segments are cinched together by a tension having a moment substantially collinear with a central axis of the waterboard.

* * * * *